US010787005B2

(12) United States Patent
Harada et al.

(10) Patent No.: US 10,787,005 B2
(45) **Date of Patent: *Sep. 29, 2020**

(54) INTERMEDIATE UNIT, POST PROCESSING DEVICE, AND PRINTING APPARATUS

(71) Applicant: SEIKO EPSON CORPORATION, Tokyo (JP)

(72) Inventors: Yutaro Harada, Nagano (JP); Kohei Ueno, Nagano (JP); Akinori Muromachi, Nagano (JP); Hidetoshi Kodama, Nagano (JP); Kazuyoshi Ohashi, Nagano (JP); Tsuyoshi Furumido, Nagano (JP); Hirohisa Adachi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/517,897

(22) Filed: Jul. 22, 2019

(65) Prior Publication Data

US 2019/0337309 A1 Nov. 7, 2019

Related U.S. Application Data

(63) Continuation of application No. 15/642,482, filed on Jul. 6, 2017, now Pat. No. 10,399,364.

(30) Foreign Application Priority Data

Jul. 13, 2016 (JP) ..... 2016-138251
Jul. 13, 2016 (JP) ..... 2016-138252
(Continued)

(51) Int. Cl.
*B41J 11/00* (2006.01)
*B41J 3/60* (2006.01)
(Continued)

(52) U.S. Cl.
CPC ..... *B41J 11/002* (2013.01); *B41J 3/60* (2013.01); *B41J 13/26* (2013.01); *B65H 29/125* (2013.01);
(Continued)

(58) Field of Classification Search
CPC ..... B41J 11/002; B41J 2/0057; B41J 13/26; B41J 3/60; B41J 29/377; B65H 29/125;
(Continued)

(56) References Cited

U.S. PATENT DOCUMENTS 6,308,026 B1 10/2001 Kouchi
6,460,687 B1 10/2002 Escobedo et al.
(Continued)

FOREIGN PATENT DOCUMENTS

JP 08-175732 A 7/1996
JP 2006-182537 A 7/2006
(Continued)

OTHER PUBLICATIONS

The Extended European Search Report for the corresponding European Patent Application No. 17180443.8 dated Dec. 8, 2017.

*Primary Examiner* — Henok D Legesse
(74) *Attorney, Agent, or Firm* — Global IP Counselors, LLP

(57) ABSTRACT

There is provided an intermediate unit including a transportation path along which a medium, on which printing has been performed by a printing unit that performs printing on the medium by using liquid, is transported to a post processing unit that performs post processing on the medium. The transportation path includes first and second inversion paths in which the medium is inverted upside down, respectively, the second inversion path being provided with a decurling unit that corrects curl of the medium, the first inversion path being not provided with the decurling unit,
(Continued)

the first and second inversion paths being selectively used to invert the medium upside down according to printing data for the medium.

20 Claims, 19 Drawing Sheets

(30) Foreign Application Priority Data

Jul. 13, 2016 (JP) ..... 2016-138253
Apr. 28, 2017 (JP) ..... 2017-089382

(51) Int. Cl.
*B41J 13/26* (2006.01)
*B65H 29/12* (2006.01)
*G03G 15/00* (2006.01)
*B41J 29/377* (2006.01)

(52) U.S. Cl.
CPC ..... *G03G 15/6573* (2013.01); *G03G 15/6582* (2013.01); *B41J 29/377* (2013.01); *B65H 2301/33312* (2013.01); *B65H 2301/517* (2013.01); *B65H 2404/1115* (2013.01); *B65H 2404/1422* (2013.01); *B65H 2404/611* (2013.01); *B65H 2404/6111* (2013.01); *B65H 2801/27* (2013.01)

(58) Field of Classification Search
CPC ..... G03G 2215/00662; G03G 15/6576; G03G 15/6567
See application file for complete search history.

(56) References Cited

U.S. PATENT DOCUMENTS

| | | | | |
|---|---|---|---|---|
| 10,399,364 | B2 * | 9/2019 | Harada | B41J 2/0057 |
| 2007/0048048 | A1 | 3/2007 | Kougami et al. | |
| 2008/0224386 | A1 | 9/2008 | Kunieda et al. | |
| 2009/0184466 | A1 | 7/2009 | Maeda et al. | |
| 2010/0002037 | A1 | 1/2010 | Kusuhata | |
| 2011/0140343 | A1 | 6/2011 | Tanaka et al. | |
| 2011/0229240 | A1 | 9/2011 | Shibayama | |
| 2012/0013671 | A1 * | 1/2012 | Houjou | B41J 11/002 347/16 |
| 2012/0256992 | A1 | 10/2012 | Hanson et al. | |
| 2013/0004652 | A1 | 1/2013 | Furukawa | |
| 2014/0062005 | A1 | 3/2014 | Suzuki et al. | |
| 2014/0354728 | A1 * | 12/2014 | Murata | B41J 3/60 347/16 |
| 2015/0116411 | A1 | 4/2015 | Suzuki | |
| 2015/0266320 | A1 | 9/2015 | Kokura | |
| 2016/0023858 | A1 | 1/2016 | Mizuno | |
| 2016/0031234 | A1 | 2/2016 | Segawa | |
| 2016/0114600 | A1 * | 4/2016 | Yamada | B41J 11/002 347/16 |
| 2016/0116881 | A1 | 4/2016 | Kodama et al. | |

FOREIGN PATENT DOCUMENTS

| | | | |
|---|---|---|---|
| JP | 2008-132692 | A | 6/2008 |
| JP | 2010-253726 | A | 11/2010 |
| JP | 2011-225312 | A | 11/2011 |
| JP | 2012-139820 | A | 7/2012 |
| JP | 2012-240773 | A | 12/2012 |
| JP | 2013-006322 | A | 1/2013 |
| JP | 2015-174331 | A | 10/2015 |
| JP | 2016-084236 | A | 5/2016 |

* cited by examiner

INTERMEDIATE UNIT, POST PROCESSING DEVICE, AND PRINTING APPARATUS

CROSS-REFERENCE TO RELATED APPLICATIONS

This application is a continuation application of U.S. patent application Ser. No. 15/642,482 filed on Jul. 6, 2017. This application claims priority to Japanese Patent Application Nos. 2017-089382 filed on Apr. 28, 2017, 2016-138251 filed on Jul. 13, 2016, 2016-138252 filed on Jul. 13, 2016, and 2016-138253 filed on Jul. 13, 2016. The entire disclosures of U.S. patent application Ser. No. 15/642,482 and Japanese Patent Application Nos. 2017-089382, 2016-138251, 2016-138252, and 2016-138253 are expressly incorporated herein by reference.

BACKGROUND

1. Technical Field

The present invention relates to an intermediate unit, a post processing device, and a printing apparatus.

2. Related Art

In the related art, as an apparatus which prints an image on a paper sheet, there is known an ink jet printer or the like, which includes a recording head that ejects ink as liquid in the form of ink droplets, for example.

Meanwhile, in a case where an image is printed by means of an ink jet printer, a paper sheet on which an image has been printed may curl (a portion of the paper sheet may curve) due to absorption of ink (moisture), the drying of ink, and the like.

Therefore, JP-A-2012-139820 discloses an ink jet printer which can prevent a paper sheet from curling since the ink jet printer includes a drying device that dries a paper sheet by applying warm air to a surface of the paper sheet on which an image is printed.

However, in the case of the ink jet printer in JP-A-2012-139820, although there is no problem for simplex printing, if images are printed on both surfaces of a paper sheet, ink on a surface that does not face a drying device may be insufficiently dried and thus it may not be possible to sufficiently suppress the curling of the paper sheet.

Therefore, in a case where paper sheets on each of which an image is printed by the ink jet printer are sequentially mounted on a processing tray, stacking failure occurs due to the curling of a paper sheet.

SUMMARY

The invention can be realized in the following aspects or application examples.

In view of the state of the known technology and in accordance with one aspect of the present disclosure, an intermediate unit comprises a transportation path along which a medium, on which printing has been performed by a printing unit that performs printing on the medium by using liquid, is transported to a post processing unit that performs post processing on the medium. The transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

In accordance with another aspect of the present disclosure, an intermediate unit comprises a transportation path along which a medium, on which printing has been performed by a printing unit that performs printing on the medium by using liquid, is transported to a post processing unit that performs post processing on the medium. The transportation path is provided with a decurling unit that a corrects curl of the medium. The transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the intermediate unit to the branch point, the second path extending from the branch point to an downstream end of the transportation path in the intermediate unit, the switch-back type inversion path extending from the branch point such that the switch-back type inversion path does not connect with the first and second paths except for the branch point. The decurling unit is provided in the switch-back type inversion path.

In accordance with another aspect of the present disclosure, a post processing device performs post processing on a medium on which printing has been performed by a printing unit that performs printing on the medium by using liquid. The post processing device comprises a post processing unit that performs the post processing on the medium, and a transportation path along which the medium is transported to the post processing unit. The transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

In accordance with another aspect of the present disclosure, a post processing device performs post processing on a medium on which printing has been performed by a printing unit that performs printing on the medium by using liquid. The post processing device comprises a post processing unit that performs the post processing on the medium, and a transportation path along which the medium is transported to the post processing unit. The transportation path is provided with a decurling unit that accelerates the decurling of the medium. The transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the intermediate unit to the branch point, the second path extending from the branch point to an downstream end of the transportation path in the intermediate unit, the switch-back type inversion path extending from the branch point such that the switch-back type inversion path does not connect with the first and second paths except for the branch point. The decurling unit is provided in the switch-back type inversion path.

In accordance with another aspect of the present disclosure, a printing apparatus comprises a printing unit that performs printing on a medium by using liquid, a post processing unit that performs post processing on the medium on which printing has been performed by the printing unit, and a transportation path along which the medium is transported from the printing unit to the post processing unit. The transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

In accordance with another aspect of the present disclosure, a printing apparatus comprises a printing unit that performs printing on a medium by using liquid, a post processing unit that performs post processing on the medium on which printing has been performed by the printing unit, and a transportation path along which the medium is transported from the printing unit to the post processing unit. The transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the intermediate unit to the branch point, the second path extending from the branch point to an downstream end of the transportation path in the intermediate unit, the switch-back type inversion path extending from the branch point such that the switch-back type inversion path does not connect with the first and second paths except for the branch point. The transportation path is provided with a decurling unit that corrects curl of the medium. The decurling unit is provided in the switch-back type inversion path.

In accordance with another aspect of the present disclosure, an intermediate unit comprises a transportation path along which a medium, on which printing has been performed by a printing unit that performs printing on the medium by using liquid, is transported to a post processing unit that performs post processing on the medium. The transportation path includes an inversion path in which the medium is inverted upside down, and includes an outlet path in which the transports the medium which transported from the inversion path to the post processing unit. The outlet path is provided with a decurling unit that corrects curl of the medium.

In accordance with another aspect of the present disclosure, a post processing device performs post processing on a medium on which printing has been performed by a printing unit that performs printing on the medium by using liquid. The post processing device comprises a post processing unit that performs the post processing on the medium, and a transportation path along which the medium is transported to the post processing unit. The transportation path includes an inversion path in which the medium is inverted upside down, and includes an outlet path in which the transports the medium which transported from the inversion path to the post processing unit. The outlet path is provided with a decurling unit that corrects curl of the medium.

In accordance with another aspect of the present disclosure, a printing apparatus comprises a printing unit that performs printing on a medium by using liquid, a post processing unit that performs post processing on the medium on which printing has been performed by the printing unit, and a transportation path along which the medium is transported from the printing unit to the post processing unit. The transportation path includes an inversion path in which the medium is inverted upside down, and includes an outlet path in which the transports the medium which transported from the inversion path to the post processing unit. The outlet path is provided with a decurling unit that corrects curl of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. Note that, in the following drawings, the scale of each member and the like is different from the actual scale so that each member and the like becomes recognizable.

First Embodiment

Configuration of Printing Apparatus

Figure 1:
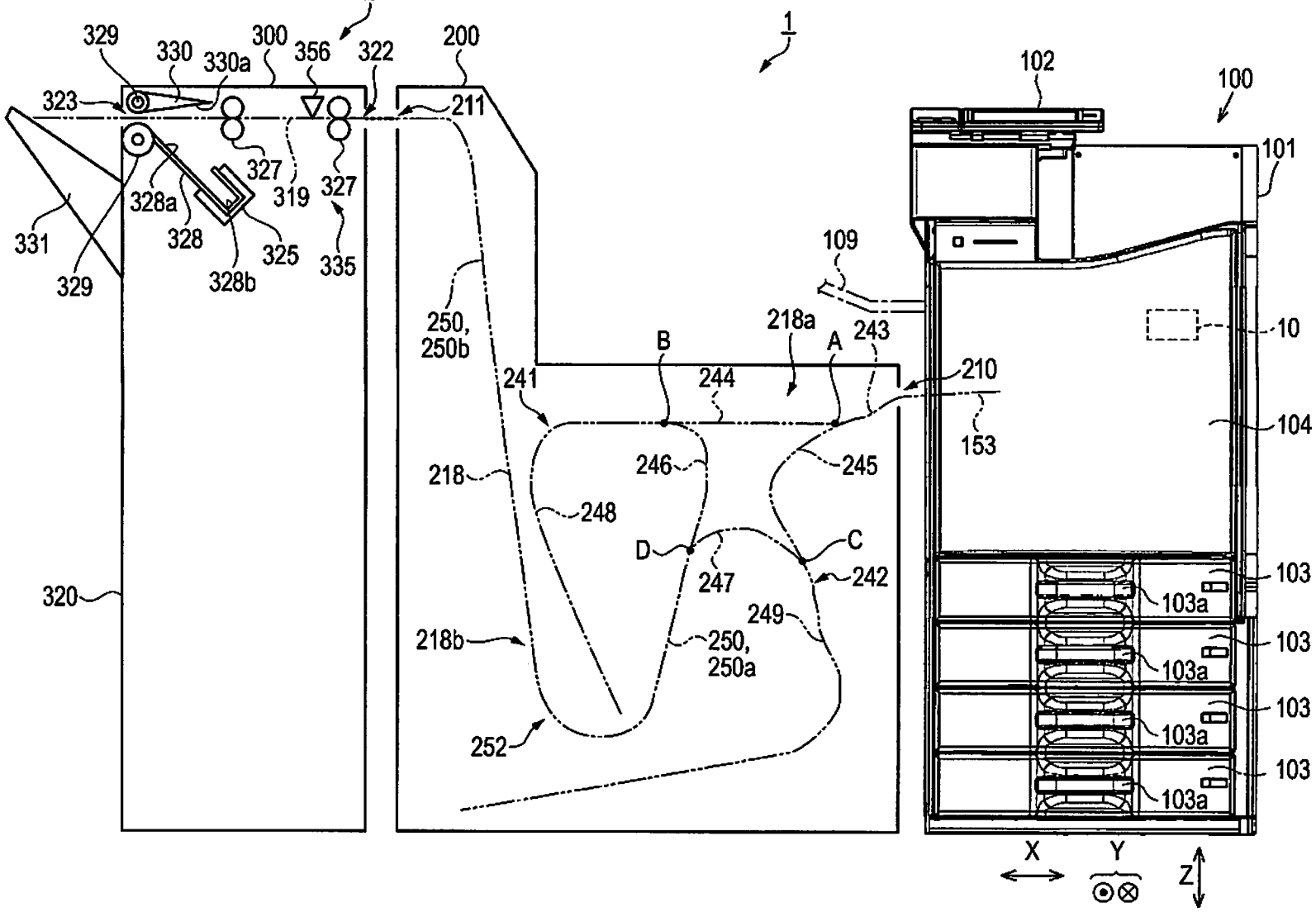
FIG. 1 is a schematic view illustrating a configuration of a printing apparatus.
Figure 2:
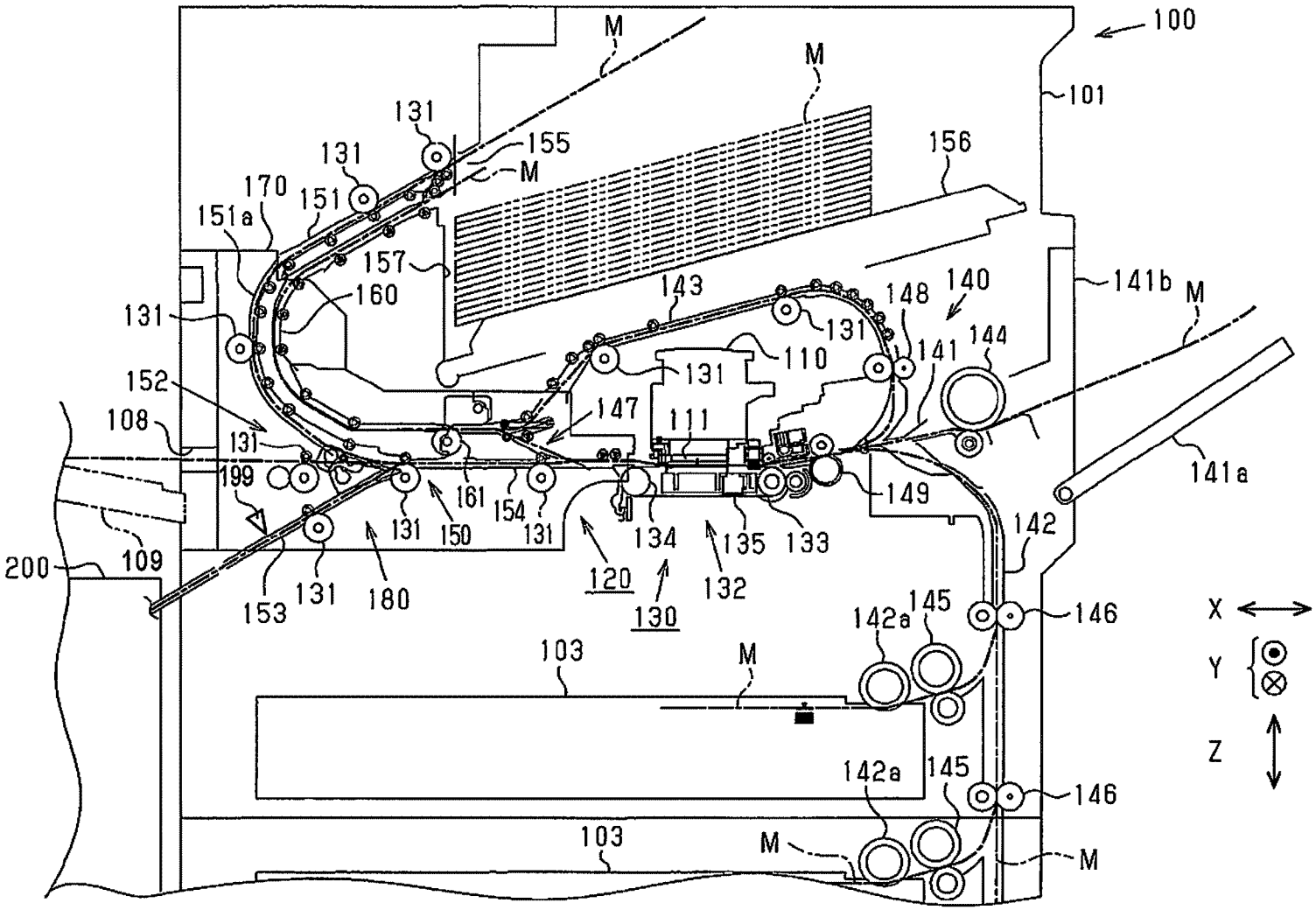
FIG. 2 is a configuration view illustrating a configuration of a printing unit.
Figure 3:
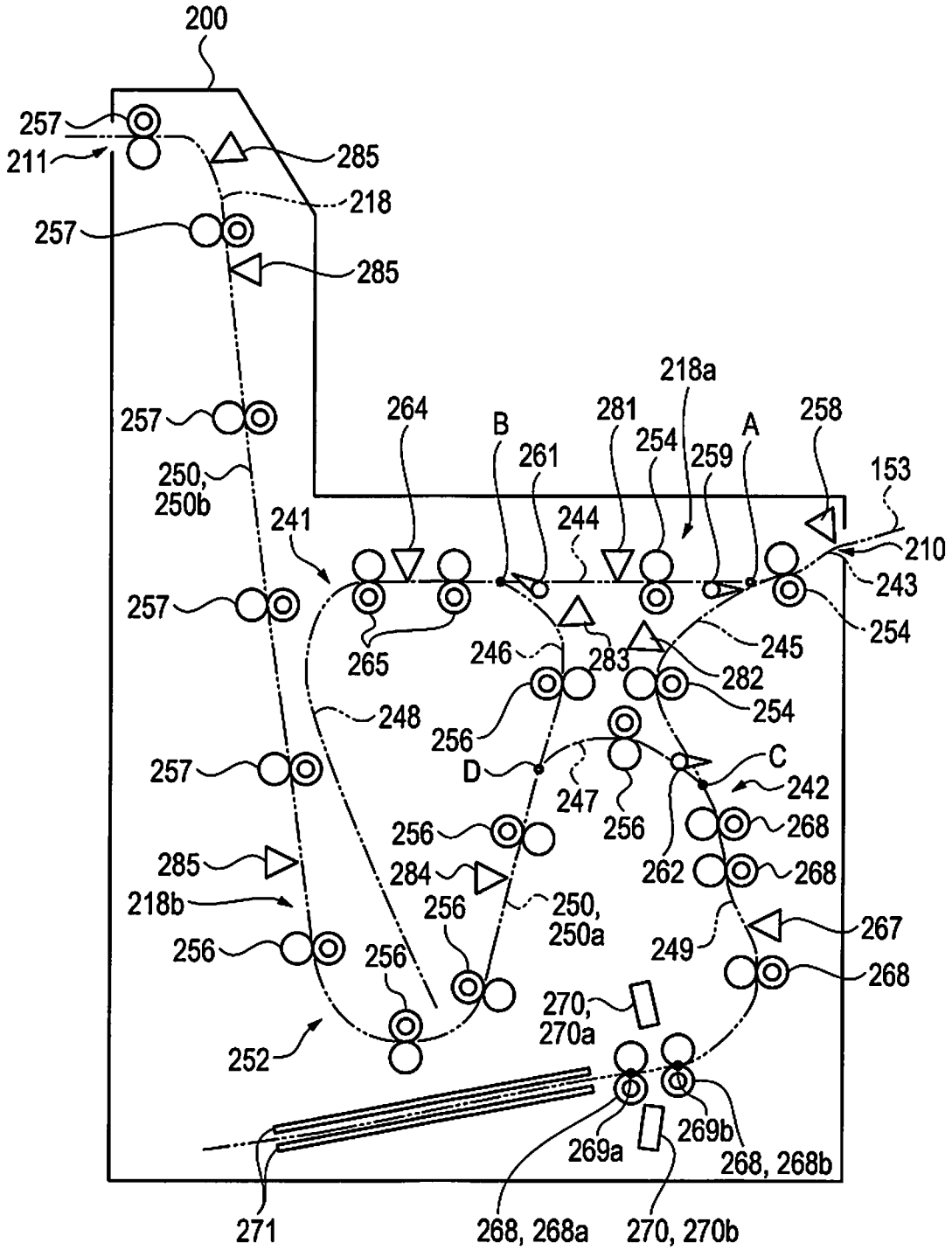
FIG. 3 is a configuration view illustrating a configuration of an intermediate unit.

First, a configuration of a printing apparatus will be described. FIG. 1 is a schematic view illustrating a configuration of the printing apparatus, FIG. 2 is a configuration view illustrating a configuration of a printing unit, and FIG. 3 is a configuration view illustrating a configuration of an intermediate unit. As illustrated in FIG. 1, a printing apparatus 1 according to the first embodiment includes a printing unit 100 as a printing unit and a post processing device 2 which is disposed beside the printing unit 100.

Furthermore, the post processing device 2 includes an intermediate unit 200 and a post processing unit 300 as a post processing unit. The printing unit 100 is a device that prints an image on a paper sheet M as a medium. In addition, the printing unit 100 includes a controller 10 that controls all of the mechanisms in the printing apparatus 1. The post processing unit 300 is a device that performs post processing such as a stapling process of binding a plurality of paper sheets M, on each of which an image is printed, with a staple (needle), for example. In addition, the intermediate unit 200 is a device that transports the paper sheet M, on which an image is printed by the printing unit 100, to the post processing unit 300. The intermediate unit 200 is disposed between the printing unit 100 and the post processing unit 300.

In the printing apparatus 1 according to the first embodiment, a third discharging path 153 of the printing unit 100 which is an upstream side transportation path is connected to a transportation path 218 at a carry-in port 210 of the intermediate unit 200 and the transportation path 218 is connected to a downstream side transportation path 319 of the post processing unit 300 at a carry-out port 211 of the intermediate unit 200. In addition, the upstream side transportation path (third discharging path 153), the transportation path 218, and the downstream side transportation path 319 constitute a transportation path (two-dotted line in FIG. 1) that extends from the printing unit 100, which is on the upstream side in a transportation direction of the paper sheet M, to the post processing unit 300 via the intermediate unit 200.

Configuration of Printing Unit

As illustrated in FIG. 1, the printing unit 100 is an ink jet printer that records an image such as a character, a drawing, and a photograph by causing ink, which is an example of liquid, to adhere to a paper sheet M, which is an example of a medium. The printing unit 100 includes a recording apparatus side housing 101 that has an approximately rectangular parallelepiped shape. An operation unit 102 for performing various operations of the printing unit 100 is attached to an upper portion of the recording apparatus side housing 101.

In the printing unit 100, paper sheet cassettes 103 are provided in an area from the central portion to the lower portion of the printing unit 100 in a vertical direction Z. In the first embodiment, four paper sheet cassettes 103 are arranged in the vertical direction Z. In each of the paper sheet cassettes 103, the paper sheets M, on which the printing unit 100 performs recording, are accommodated being in a stacked state. In addition, in each of the paper sheet cassettes 103, a grip portion 103*a* which a user can grip is formed. In addition, the paper sheet cassette 103 is configured to be capable of being detached from the recording apparatus side housing 101. Note that, paper sheets M accommodated in each paper sheet cassette 103 may be different in type and may be the same in type.

A rectangular front plate cover 104 is provided above the uppermost paper sheet cassette 103 in the vertical direction Z. The front plate cover 104 is provided to be capable of rotating with a long side adjacent to the paper sheet cassette 103 as a base end and the front plate cover 104 is configured to be capable of rotating between two positions of an opening position, at which a tip end that is opposite to the base end is separated from the printing unit 100, and a closing position, at which the front plate cover 104 constitutes a portion of the recording apparatus side housing 101.

In addition, as illustrated in FIG. 2, a discharging port 108 through which the paper sheet M is discharged is formed in a portion of the recording apparatus side housing 101 which is on the intermediate unit 200 side. In addition, a discharging tray 109 that extends from the recording apparatus side housing 101 to the intermediate unit 200 side is provided below the discharging port 108 such that the discharging tray 109 can be attached as necessary. That is, the paper sheet M discharged through the discharging port 108 is mounted on the discharging tray 109. Note that, the discharging tray 109 is configured to be capable of being detached from the recording apparatus side housing 101 and is inclined such that the height thereof increases from the base end, which is connected to the recording apparatus side housing 101, toward a tip end, which is opposite to the base end (left-upward direction in FIG. 2).

As illustrated in FIG. 2, in the recording apparatus side housing 101 which is included in the printing unit 100, a recording unit 110 which performs recording on the paper sheet M while being positioned above the paper sheet M in the vertical direction Z and a transportation unit 130 which transports the paper sheet M along an in-device transportation path 120 are provided. The in-device transportation path 120 is formed such that the paper sheet M is transported in a transportation direction which is a direction intersecting a width direction of the paper sheet M, the width direction being a direction parallel to a front-rear direction Y.

The recording unit 110 includes a line-head type recording head 111 which can eject ink over the entire area in the width direction of the paper sheet M at once. The recording unit 110 prints an image on the paper sheet M by causing ink ejected from the recording head 111 to adhere to a recording surface of the paper sheet M which faces the recording head 111 (surface on which image is printed).

The transportation unit 130 includes a plurality of pairs of transportation rollers 131, which are arranged along the in-device transportation path 120 and are driven by a transportation driving motor (not shown), and a belt transportation unit 132 which is provided immediately below the recording unit 110. That is, recording is performed with ink being ejected from the recording head 111 to the paper sheet M, which is in a state of being transported by the belt transportation unit 132.

The belt transportation unit 132 includes a driving roller 133 which is disposed on the upstream side of the recording head 111 in the transportation direction, a driven roller 134 which is disposed on the downstream side of the recording head 111 in the transportation direction, and an endless annular belt 135 which is suspended between the rollers 133 and 134. When the driving roller 133 rotates, the belt 135 rotates in a circumferential direction thereof and the paper sheet M is transported to the downstream side with the belt 135 rotating in the circumferential direction. That is, the outer circumferential surface of the belt 135 functions as a supporting surface which supports the paper sheet M on which recording is performed.

The in-device transportation path 120 includes a supply path 140 along which the paper sheet M is transported to the recording unit 110, a discharging path 150 along which the paper sheet M after recording on which recording has been performed by the recording unit 110 is transported, and a branch path 160 which branches off from the discharging path 150.

The supply path 140 includes a first supply path 141, a second supply path 142, and a third supply path 143. In the first supply path 141, the paper sheet M which is inserted through an insertion port 141*b*, which is exposed when a cover 141*a* provided on a right side surface of the recording apparatus side housing 101 is opened, is transported to the recording unit 110. That is, the paper sheet M which is inserted through the insertion port 141*b* is linearly transported to the recording unit 110 with rotation of a pair of first driving rollers 144.

In the second supply path 142, the paper sheets M which are accommodated in each of the paper sheet cassettes 103, which are provided in the lower portion of the recording apparatus side housing 101 in the vertical direction Z, are transported to the recording unit 110. That is, the uppermost paper sheet M of the paper sheets M, which are accommodated in the paper sheet cassettes 103 in a state of being stacked, is fed by a pickup roller 142*a* and is transported to the recording unit 110 with rotation of a pair of second driving rollers 146 while being inverted in the vertical direction Z after the paper sheets M are separated from each other by a pair of separating rollers 145 in a one-by-one manner.

In the third supply path 143, in the case of duplex printing in which images are recorded on both surfaces of the paper sheet M, the paper sheet M with one surface on which recording has been performed by the recording unit 110 is transported to the recording unit 110 again. That is, the branch path 160 which branches off from the discharging path 150 is provided on the downstream side of the recording unit 110 in the transportation direction. That is, when duplex printing is performed, the paper sheet M is transported to the branch path 160 with a branch mechanism 147 being operated, the branch mechanism 147 being provided in the middle of the discharging path 150. In addition, in the branch path 160, a pair of branch path rollers 161 which can be rotated forwards and backwards is provided on the downstream side of the branch mechanism 147.

When duplex printing is performed, the paper sheet M with one surface on which printing has been performed is once guided to the branch path 160 by the branch mechanism 147 and is transported to the downstream side in the branch path 160 by the pair of branch path rollers 161 rotating forwards. Thereafter, the paper sheet M which has been transported to the branch path 160 is reversely transported from the downstream side to the upstream side in the branch path 160 by the pair of branch path rollers 161 rotating backwards. That is, the transportation direction of the paper sheet M which is transported along the branch path 160 is reversed.

The paper sheet M which is reversely transported from the branch path 160 is transported to the third supply path 143 and is transported to the recording unit 110 by the plurality of pairs of transportation rollers 131. When the paper sheet M is transported along the third supply path 143, the paper sheet M is inverted such that a surface thereof on which printing has not been performed faces the recording unit 110 and the paper sheet M is transported to the recording unit 110 with rotation of a third pair of driving rollers 148. That is, the third supply path 143 functions as an inversion transportation path along which the paper sheet M is transported while being inverted in the vertical direction Z.

In the second supply path 142 and the third supply path 143 from among the supply paths 141, 142, and 143, the paper sheet M is transported to the recording unit 110 while being curved in the vertical direction Z. Meanwhile, in the first supply path 141, the paper sheet M is transported to the recording unit 110 while being curved more slightly than in the second supply path 142 and the third supply path 143.

The leading end of the paper sheet M which is transported along the supply paths 141, 142, and 143 comes into contact with a pair of alignment rollers 149 of which rotation has been stopped after being transported to the pair of alignment rollers 149, which is provided on the upstream side of the recording unit 110 in the transportation direction. Then, an inclination of the paper sheet M with respect to the transportation direction is corrected (skew correction) in a state where the paper sheet M is in contact with the pair of alignment rollers 149. Thereafter, with rotation of the pair of alignment rollers 149, the paper sheet M of which the inclination has been corrected is transported to the recording unit 110 in a state of being aligned.

The paper sheet M with one surface or both surfaces on which recording has been performed by the recording unit 110 and the recording is finished is transported by the pairs of transportation rollers 131 along the discharging path 150 which constitutes a downstream side portion of the in-device transportation path 120. The discharging path 150 branches into a first discharging path 151, a second discharging path 152, and the third discharging path 153 at a position on the downstream side of a position at which the branch path 160 branches off from the discharging path 150. That is, after being transported along a common discharging path (upstream side discharging path) 154 which constitutes an upstream side portion of the discharging path 150, the paper sheet M on which recording is finished is guided by a guiding mechanism (switch guiding unit) 180 to any one of the first to third discharging paths 151, 152, and 153 which constitute the downstream side portion of the discharging path 150. The guiding mechanism 180 is provided at a downstream end of the common discharging path 154.

The first discharging path (upper discharging path) 151 is provided to extend to an upper portion of the recording apparatus side housing 101 and to extend being curved along the branch path 160. The paper sheet M which is transported along the first discharging path 151 is discharged via a discharging port 155 which opens at a portion of the recording apparatus side housing 101 so as to function as a terminal end of the first discharging path 151. In addition, the paper sheets M which are discharged through the discharging port 155 fall downward in the vertical direction Z and are discharged to a mounting table 156 in a state of being stacked as illustrated by two-dotted lines in FIG. 2. Note that, the paper sheet M is discharged by the plurality of pairs of transportation rollers 131, which are disposed in the discharging path 150, to the mounting table 156 through the discharging port 155 in such a posture that the recording surface at the time of simplex printing faces downward in the vertical direction Z.

The mounting table 156 has a tip end-rising inclined shape in which the height in the vertical direction Z increases toward the right side in a transverse direction X, and the paper sheets M are mounted on the mounting table 156 in a state of being stacked. At this time, the paper sheets M mounted on the mounting table 156 move to the left side along a slope of the mounting table 156 and are mounted being close to a vertical side wall 157 which is provided below the discharging port 155 of the recording apparatus side housing 101.

In addition, the first discharging path 151 includes a curved inversion path 151*a* in which the paper sheet M on which recording has been performed by the recording unit 110 is inverted upside down when the paper sheet M is transported to the discharging port 155. That is, in the curved inversion path 151*a*, the paper sheet M on which recording has been performed by the recording unit 110 is curved with the recording surface disposed on the inner side and the paper sheet M is inverted so that a state where the recording surface of the paper sheet M faces upward in the vertical direction Z changes to a state where the recording surface faces downward in the vertical direction Z. Therefore, in the discharging path 150, the paper sheet M passes through the curved inversion path 151*a* so that the paper sheet M is discharged through the discharging port 155 in a state where the recording surface at the time of simplex printing faces the mounting table 156.

The second discharging path 152 branches toward a lower position in the vertical direction Z than the first discharging path 151 and extends linearly (horizontally) from the recording unit 110 to the intermediate unit 200. Therefore, the paper sheet M which is transported along the second discharging path 152 is not transported being curved as in the case of the first discharging path 151 and is discharged toward the discharging tray 109 through the discharging port 108 after being linearly transported in the same posture as when passing through the recording unit 110 with the posture thereof being maintained constant. That is, the second discharging path 152 functions as a non-inversion discharging path along which the paper sheet M is transported to the discharging tray 109 with the paper sheet M being not inverted.

The third discharging path 153 branches to a lower position in the vertical direction Z than the second discharging path 152 and obliquely extends downward in the vertical direction Z such that the third discharging path 153 extends toward a lower portion of the recording apparatus side housing 101. In addition, the downstream end of the third discharging path 153 is connected to the transportation path 218 included in the intermediate unit 200. That is, the paper sheet M which is transported along the third discharging path 153 is discharged to the intermediate unit 200. Note that, the third discharging path 153 is provided with a transportation detecting unit 199 which can detect presence or absence of the paper sheet M. The transportation detecting unit 199 is a light transmitting photo interrupter or a light reflecting photo interrupter and includes a light emitting unit which emits light and a light receiving unit which receives light emitted from the light emitting unit. As a light emitting element in the light emitting unit, a light emitting diode (LED), a laser light emitting element, or the like is used. In addition, the light receiving unit is constituted by a photo transistor, a photo IC, or the like. With the light emitting unit and the light receiving unit, it is possible to detect presence or absence of the paper sheet M (whether the light receiving unit receives light or not).

The transportation detecting unit 199 is connected to the controller 10 and is controlled on the basis of a predetermined program. The controller 10 drives the transportation detecting unit 199 and presence or absence of the paper sheet M is detected through comparison between a light receiving amount of the light receiving unit and a predetermined threshold value. In a case where presence and absence of the paper sheet M are repeatedly detected in synchronization with the driving of the pair of transportation rollers 131, it is determined that the paper sheet M is in a state of being transported normally. On the other hand, in a case where the light receiving amount of the light receiving unit does not change at a predetermined time point or for a predetermined time period, it is determined that the paper sheet M is in an abnormal state (jammed state). For example, in a case where the paper sheet M is not transported normally from the recording head 111 side due to transportation failure of the paper sheet M, it is determined that the paper sheet M is in an abnormal state (jammed state).

A portion of the discharging path 150 and a portion of the branch path 160 are attached to a drawer unit 170 which is provided in the recording apparatus side housing 101. Note that, the drawer unit 170 is configured to be capable of being detached from the recording apparatus side housing 101.

Here, it is preferable that the paper sheet M which can be used in the printing apparatus 1 be a hygroscopic and flexible paper sheet. Examples thereof include a plain paper sheet such as an electrophotographic copying paper sheet, an ink jet paper sheet with a water-soluble ink absorbing layer containing silica, alumina, polyvinyl alcohol (PVA), and polyvinyl pyrrolidone (PVP), and the like. In addition, examples of a type of absorptive recording medium having a relatively small water-soluble ink penetration rate include an art paper sheet, a coated paper sheet, a cast paper sheet, and the like which are used for general offset printing.

Note that, in the first embodiment, the "paper sheet M" means a paper sheet defined in No. 6139 of JIS-P-0001, of which the main material is pulp (main component is cellulose) and which is used in a printer or the like. Specific examples thereof include a high quality paper sheet, a PPC copy paper sheet, an uncoated printing paper sheet, and the like. As the paper sheet M, a commercially available paper sheet can be used and examples thereof include various paper sheets such as Xerox 4200 (manufactured by Fuji Xerox Co., Ltd.) and GeoCycle (manufactured by Georgia-Pacific Corporation). In addition, the basis weight of the paper sheet M is preferably 60 to 120 g/m$^2$.

Next, an ink composition which is used in the printing apparatus 1 (printing unit 100) according to the first embodiment will be described.

Ink Composition

Next, ink (ink composition) which is recording material used in the printing apparatus 1 (printing unit 100) according to the first embodiment will be described.

It is preferable that the ink be an aqueous ink composition, in which the main solvent of ink is water, in view of safety, a handling property, and various performances (color developing property, strike-through suitability, ink reliability, and the like). Note that, the strike-through suitability is a property of being suitable for suppressing strike-through of ink which occurs due to excessive penetration of ink with respect to a recording medium.

It is preferable to use pure water or ultrapure water such as ion exchanged water, ultra-filtered water, reverse osmosis water, distilled water or the like as the water. Particularly, it is preferable to use water sterilized through ultraviolet irradiation or addition of hydrogen peroxide in view of preventing mold and bacteria from being generated so that ink can be preserved for a long period of time.

In addition, it is preferable that the ink composition contain 10% by mass to 75% by mass of water in view of securing appropriate physical property values (viscosity and the like) of ink and securing stability and reliability of ink.

Examples of the ink include ink (for example, cyan ink, magenta ink, yellow ink, and the like) corresponding to full-color recording (image printing or text printing), black ink, white ink, and the like and each of the above-described types of inks contains coloring material.

It is preferable that at least one of a pigment, a dye, a metal oxide and the like be contained in ink of each color as the coloring material.

The type of pigment is not particularly limited and examples thereof include an inorganic pigment or an organic pigment for black, and an organic pigment for each of colors such as yellow, magenta and cyan.

Regarding the dye, various dyes such as a direct dye, an acidic dye, an edible dye, a basic dye, a reactive dye, a disperse dye, a vat dye, a soluble vat dye, a reactive disperse dye, and the like can be used as a dye for each of colors such as yellow, magenta, and cyan.

In addition, the ink may contain a water-soluble organic solvent, polyhydric alcohols, betaines, saccharides, ureas, and a surfactant in addition to the coloring material in order to achieve a predetermined ink characteristic. Examples of the predetermined ink characteristic include a wetting property and a penetrating ability of ink with respect to the recording medium, curling suitability of the recording medium, cockling suitability, strike-through suitability, clogging suitability in ink ejection, a temperature-related viscosity characteristic of the ink, and the like.

Specifically, for example, 1,2-alkanediol, glycol ether, pyrrolidone derivative, and the like can be used as the water-soluble organic solvent and glycerin, 1,2,6-hexanetriol, diethylene glycol, triethylene glycol, tetraethylene glycol, dipropylene glycol and the like can be used as the polyhydric alcohols. As the surfactant, known fluorine-based surfactant, an acetylene glycol-based surfactant, a silicon-based surfactant and the like can be used.

When adding a pigment to the ink, a dispersant for dispersing the pigment may be added as an additional component. In addition, a pH conditioner, a complexing agent, an antifoaming agent, an antioxidant, an ultraviolet absorbing agent, an antiseptic and antifungal agent, and the like may be added to the ink in order to further improve the characteristics of ink.

Configuration of Intermediate Unit

Next, the intermediate unit 200 will be described. As illustrated in FIG. 1, the intermediate unit 200 includes the transportation path 218 along which the paper sheet M can be transported from the carry-in port 210 to the carry-out port 211. In addition, the transportation path 218 is provided with an intermediate transportation unit 252 which includes at least one inverting unit (in first embodiment, two inverting units of first inverting unit 241 and second inverting unit 242) that inverts the transported paper sheet M. The first inverting unit 241 and the second inverting unit 242 are positioned on the downstream side of the recording unit 110 in the transportation direction in the transportation path 218 and invert the paper sheet M on which an image has been printed. In addition, the intermediate unit 200 includes the transportation path 218 along which the paper sheet M is transported. Accordingly, the intermediate unit 200 has a drying function of drying the paper sheet M on which an image has been printed in the printing unit 100 while transporting the paper sheet M and a switch-back inverting function of inverting the paper sheet M which is transported from the printing unit 100.

The transportation path 218 of the intermediate unit 200 is connected to the third discharging path 153 of the printing unit 100 at the carry-in port 210. In addition, the transportation path 218 includes an inlet path 243 of which the upstream end is connected to the third discharging path 153 and a first branch path 244 and a second branch path 245 which branch off at a branch point A which is the downstream end of the inlet path 243. That is, the downstream end of the inlet path 243, the upstream end of the first branch path 244, and the upstream end of the second branch path 245 are connected to the branch point A. In addition, the lengths of the first branch path 244 and the second branch path 245 in the transportation direction are substantially the same.

Furthermore, the transportation path 218 includes a first junction path 246 which is connected to a first connection point B which is the downstream end of the first branch path 244 and a second junction path 247 which is connected to a second connection point C which is the downstream end of the second branch path 245. The lengths of the first junction path 246 and the second junction path 247 in the transportation direction are substantially the same.

In addition, a switch-back type first inversion path 248 which the first inverting unit 241 includes is connected to the first connection point B. In addition, a switch-back type second inversion path 249 which the second inverting unit 242 includes is connected to the second connection point C. That is, the downstream end of the first branch path 244, the upstream end of the first junction path 246, and one end of the first inversion path 248 are connected to the first connection point B. In addition, the downstream end of the second branch path 245, the upstream end of the second junction path 247, and one end of the second inversion path 249 are connected to the second connection point C. Note that, the lengths of the first inversion path 248 and the second inversion path 249 in the transportation direction are equal to or greater than the maximum length of the paper sheet M on which an image can be printed in the printing unit 100.

Furthermore, the transportation path 218 is provided with a junction point D at which the first junction path 246 and the second junction path 247 join each other and the transportation path 218 includes an outlet path 250 which is connected to the junction point D. That is, the downstream end of the first junction path 246, the downstream end of the second junction path 247, and the upstream end of the outlet path 250 are connected to the junction point D. The outlet path 250 extends downward in an area between the first inversion path 248 and the second inversion path 249 toward the post processing unit 300, curves round the first inversion path 248, and extends upward. Note that, the outlet path 250 is constituted of a first outlet path **250*a* which is disposed on the upstream side and a second outlet path 250*b* which is disposed on the downstream side of the first outlet path 250*a*. In addition, the downstream end of the second outlet path 250*b* is connected to the downstream side transportation path 319 of the post processing unit 300 at the carry-out port 211**.

In addition, in the first embodiment, the inlet path 243, the first branch path 244, the second branch path 245 constitute a pre-inversion path **218*a* and the first junction path 246, the second junction path 247, and the outlet path 250 constitute a post-inversion path 218*b*. In addition, the pre-inversion path 218*a* is positioned on the upstream side of the first inverting unit 241 or the second inverting unit 242 in the transportation direction. Furthermore, the post-inversion path 218*b* is positioned on the downstream side of the first inverting unit 241 or the second inverting unit 242 in the transportation direction. That is, the transportation path 218 includes the pre-inversion path 218*a* which is positioned on the upstream side of the first inverting unit 241 and the second inverting unit 242 in the transportation direction and the post-inversion path 218***b* which is positioned on the downstream side of the first inverting unit 241 and the second inverting unit 242 in the transportation direction.

In addition, as illustrated in FIG. 3, the intermediate unit 200 includes the intermediate transportation unit 252 that can transport the paper sheet M along the transportation path 218. The first inverting unit 241 and the second inverting unit 242 in the intermediate transportation unit 252 are configured to be capable of inverting the transported paper sheet M.

A pair of first transportation rollers 254 which is driven by a first driving motor (not shown) is disposed on each of the inlet path 243, the first branch path 244, and the second branch path 245. In addition, a pair of second transportation rollers 256 which is driven by a second driving motor (not shown) is disposed on each of the first junction path 246, the second junction path 247, and the first outlet path 250*a*. In addition, pairs of third transportation rollers 257 which are driven by a third driving motor (not shown) are disposed on the second outlet path 250*b*. The number of the pairs of first transportation rollers 254, the pairs of second transportation rollers 257, and the pairs of third transportation rollers 256 can be arbitrarily set according to the shape or the like of each transportation path. In addition, one roller in each pair of rollers is driven in a state where both of the front and rear surfaces of the paper sheet M are supported while being interposed between each pair of rollers in the intermediate transportation unit 252 so that the paper sheet M is transported along the transportation path.

In addition, the inlet path 243 is provided with an introduction detecting unit 258 that detects the paper sheet M. The introduction detecting unit 258 is, for example, a photo interrupter and the specific configuration thereof is the same as that of the transportation detecting unit 199. In addition, the branch point A, which is on the downstream side of the introduction detecting unit 258 in the transportation direction, is provided with a guide flap 259. The guide flap 259 is driven by a solenoid or the like and switches a path to which the paper sheet M transported along the inlet path 243 is guided between the first branch path 244 and the second branch path 245.

Furthermore, a first restriction flap 261 that allows the paper sheet M to move from the first branch path 244 to the first inversion path 248 but restricts the paper sheet M from moving from the first inversion path 248 to the first branch path 244 is provided at the downstream end of the first branch path 244. Furthermore, a second restriction flap 262 that allows the paper sheet M to move from the second branch path 245 to the second inversion path 249 but restricts the paper sheet M from moving from the second inversion path 249 to the second branch path 245 is provided at the downstream end of the second branch path 245. The first restriction flap 261 and the second restriction flap 262 are urged so as to block the downstream end of the first branch path 244 or the second branch path 245 due to an urging force from an urging member (not shown).

In addition, on the first branch path 244, a first detecting unit 281 that detects the paper sheet M is disposed and on the second branch path 245, a second detecting unit 282 that detects the paper sheet M is disposed. In addition, on the first junction path 246, a third detecting unit 283 that detects the paper sheet M is disposed. Furthermore, on the first outlet path 250*a*, a fourth detecting unit 284 that detects the paper sheet M is disposed and on the second outlet path 250*b*, a fifth detecting unit 285 that detects the paper sheet M is disposed. Note that, the first to fifth detecting units 281, 282, 283, 284, and 285 are, for example, photo interrupters and the specific configuration thereof is the same as that of the transportation detecting unit 199. Note that, the number of each detecting unit in each transportation path can be arbitrarily set according to the shape or the like of each transportation path.

In the first inverting unit 241, a first inversion detecting unit 264 that detects the paper sheet M fed to the first inversion path 248 and pairs of first inverting rollers 265 (in the first embodiment, two pairs), which are provided on the first inversion path 248, are disposed. The pairs of first inverting rollers 265 are driven forwards or backwards by a first inversion motor (not shown) on the basis of a signal which the first inversion detecting unit 264 transmits when the first inversion detecting unit 264 detects the paper sheet M.

In addition, in the second inverting unit 242, a second inversion detecting unit 267 that detects the paper sheet M fed to the second inversion path 249 and pairs of second inverting rollers 268 (in the first embodiment, five pairs), which are provided on the second inversion path 249, are disposed. The pairs of second inverting rollers 268 are driven forwards or backwards by a second inversion motor (not shown) on the basis of a signal which the second inversion detecting unit 267 transmits when the second inversion detecting unit 267 detects the paper sheet M. Note that, the first and second inversion detecting units 264 and 267 are, for example, photo interrupters and the specific configuration thereof is the same as that of the transportation detecting unit 199. Note that, from among the pairs of second inverting rollers 268 provided on the second inversion path 249, two pairs of second inverting rollers 268 that are disposed on the downstream side in the second inversion path 249 function as a pair of first rollers 268*a* that constitutes a first holding unit 269*a* nipping and holding the paper sheet M (refer to FIG. 3) and a pair of second rollers 268*b* that constitutes a second holding unit 269*b* (refer to FIG. 3). In addition, the pair of first rollers 268*a* is disposed on the downstream side of the pair of second rollers 268*b* in the second inversion path 249. That is, the pair of second rollers 268*b* is disposed at a position behind the pair of first rollers 268*a* in a direction in which the paper sheet M enters the second inversion path 249.

In addition, in the second inverting unit 242, drying units 270 (in the first embodiment, two drying units of a first drying unit 270*a* and a second drying unit 270*b* (refer to FIG. 8)) for accelerating the drying of the paper sheet M are provided at a position facing the second inversion path 249. The drying units 270 are disposed on the upstream side of the pair of first rollers 268*a* in a direction in which the paper sheet M enters the second inversion path 249, the first drying unit 270*a* is disposed at a position facing one surface of the paper sheet M, and the second drying unit 270*b* is disposed at a position facing the other surface of the paper sheet M. Note that, each of the drying units 270 (270*a* and 270*b*) is configured to include an air blower and air from the air blower is sent toward the paper sheet M. In addition, if each of the drying units 270 (270*a* and 270*b*) is configured to further include a heater, it is possible to further accelerate the drying of the paper sheet M since it is possible to send warm air to the paper sheet M.

In addition, in the second inverting unit 242, two guide plates 271 for linearly guiding the paper sheet M are disposed at a position facing one surface of the paper sheet M and a position facing the other surface of the paper sheet M, respectively, with the second inversion path 249 interposed therebetween. Note that, each of the guide plates 271 has a flat plate-like shape, has a mesh-like shape with penetration holes provided thereon, and is processed such that air from the air blower of each drying unit 270 (270*a* and 270*b*) is likely to be applied to the paper sheet M. In addition, each of the guide plates 271 may have a frame shape including an opening portion in the central portion thereof and the opening portion may be provided with a plurality of wire rods extending along the transportation direction.

Configuration of Post Processing Unit

Next, the post processing unit 300 will be described. As illustrated in FIG. 1, the post processing unit 300 includes an approximately box-shaped frame body 320. The frame body 320 includes a post processing paper feeding port 322 and a post processing paper discharging port 323. An opening is formed in each of the post processing paper feeding port 322 and the post processing paper discharging port 323 and the post processing paper feeding port 322 is disposed corresponding to the downstream end of the transportation path 218 of the intermediate unit 200 so that the transportation path 218 and the downstream side transportation path 319 are connected to each other. In addition, the downstream side transportation path 319 is disposed over an area from the post processing paper feeding port 322 to the post processing paper discharging port 323, the paper sheet M transported from the intermediate unit 200 is supplied via the post processing paper feeding port 322, and the paper sheet M is discharged via the post processing paper discharging port 323 after being subject to post processing or the like.

In the frame body 320, a stacker 328, a processing unit 325, and the like are disposed. The paper sheet M is temporarily mounted on the stacker 328 and the stacker 328 includes a mounting surface 328*a* on which the paper sheet M can be mounted and which is a substantially flat surface, and a wall surface 328*b* which is formed to extend in a direction substantially perpendicular to an end of the mounting surface 328*a*.

The processing unit 325 performs post processing such as a punching process of punching a punched hole through the paper sheet M, a stapling process of binding a predetermined number of paper sheets M, and a shifting process of shifting the position of the paper sheet M in the width direction thereof per one paper sheet M or per one bundle of paper sheets M for adjustment with respect to the paper sheet M mounted on the stacker 328 by using an appropriate mechanism. Note that, the processing unit 325 may include a paper sheet folding unit that performs a folding process of the paper sheet M and a mechanism that is capable of performing a cutting process of cutting the paper sheet M, a quire making process of folding the paper sheet M, a bookbinding process of assembling a book from the paper sheet M, a gathering process and the like.

In addition, in the frame body 320, a downstream side transportation unit 335 is disposed along the downstream side transportation path 319. The downstream side transportation unit 335 includes a pair of transportation rollers 327 which is driven by a driving roller (not shown). In addition, a pair of discharging rollers 329 is disposed in the vicinity of the post processing paper discharging port 323 in the downstream side transportation path 319. The pair of transportation rollers 327 is disposed on the upstream side of the stacker 328 and the processing unit 325 in the downstream side transportation path 319 and transports the paper sheet M, which is fed from the post processing paper feeding port 322, to the stacker 328. In addition, a transportation detecting unit 356 that detects the paper sheet M is disposed in the vicinity of the post processing paper feeding port 322 in the downstream side transportation path 319. The transportation detecting unit 356 is, for example, a photo interrupter and the specific configuration thereof is the same as that of the transportation detecting unit 199.

In addition, in the frame body 320, a guiding unit 330 that guides the paper sheet M transported along the downstream side transportation path 319 is provided. The guiding unit 330 has a projection-like shape. In addition, the guiding unit 330 includes a guiding surface 330*a* that is a substantially flat surface and the guiding surface 330*a* is disposed to face the downstream side transportation path 319 (stacker 328). The width dimension of the guiding surface 330*a* in the first embodiment in a direction approximately orthogonal to the transportation direction of the paper sheet M is substantially the same as the width dimension of the paper sheet M in a direction approximately orthogonal to the transportation direction. Accordingly, it is possible to transport the paper sheet M with ease. The guiding unit 330 is disposed on the downstream side of the pair of transportation rollers 327 in the downstream side transportation path 319 and is disposed on the upstream side of the pair of discharging rollers 329. Therefore, the paper sheet M transported from the pair of transportation rollers 327 is transported to the stacker 328 via the guiding unit 330.

The stacker 328 in the first embodiment is disposed on the downstream side of the pair of transportation rollers 327 in the downstream side transportation path 319 and the paper sheet M processed in the processing unit 325 is temporarily mounted on the stacker 328. In addition, the mounting surface 328*a* of the stacker 328 is disposed in an oblique direction so that at least one end sides of the plurality of paper sheets M mounted on the stacker 328 are aligned. In the first embodiment, one end of the stacker 328 is disposed on the post processing paper discharging port 323 side and the other end (wall surface 328*b*) of the stacker 328 is disposed on the processing unit 325 side. The post processing paper discharging port 323 is disposed above the processing unit 325 and the stacker 328 is disposed obliquely so that the height thereof decreases toward the processing unit 325. Therefore, one end sides of the paper sheets M mounted on the stacker 328 come into contact with the wall surface 328*b* of the stacker 328 and one end sides of the paper sheets M are aligned.

Operating Method of Printing Apparatus

Next, a basic operating method of the printing apparatus 1 will be described. FIGS. 4 to 7 are schematic views illustrating an operating method of the printing apparatus. Hereinafter, transportation of the paper sheet M, which is transported from the printing unit 100 to the post processing unit 300 through the intermediate unit 200, will be described. Note that, the first to third paper sheets M of the paper sheets M which are supplied to the recording head 111 of the printing unit 100 transported are called a first paper sheet Ma, a second paper sheet Mb, and a third paper sheet Mc, respectively. In addition, the fourth paper sheet M is called a fourth paper sheet Md and the description below will be made on the assumption that all of the fourth paper sheet M are paper sheets M for which a drying process is omitted.

First, when a printing process (image printing process) is executed, the controller 10 drives each of the driving motors and the like. As a result, the pickup roller 142*a*, the pair of transportation rollers 131, the driving roller 133, the pair of first transportation rollers 254, the pair of second transportation rollers 256, the third pair of transportation rollers 257, the pair of first inverting rollers 265, the pair of second inverting rollers 268, the pair of transportation rollers 327, and the like, which are connected to each driving roller, are driven.

Then, the recording unit 110 prints an image by ejecting ink from the recording head 111 to the paper sheet M. In this case, the printing process may be any of simplex printing and duplex printing.

Figure 4:
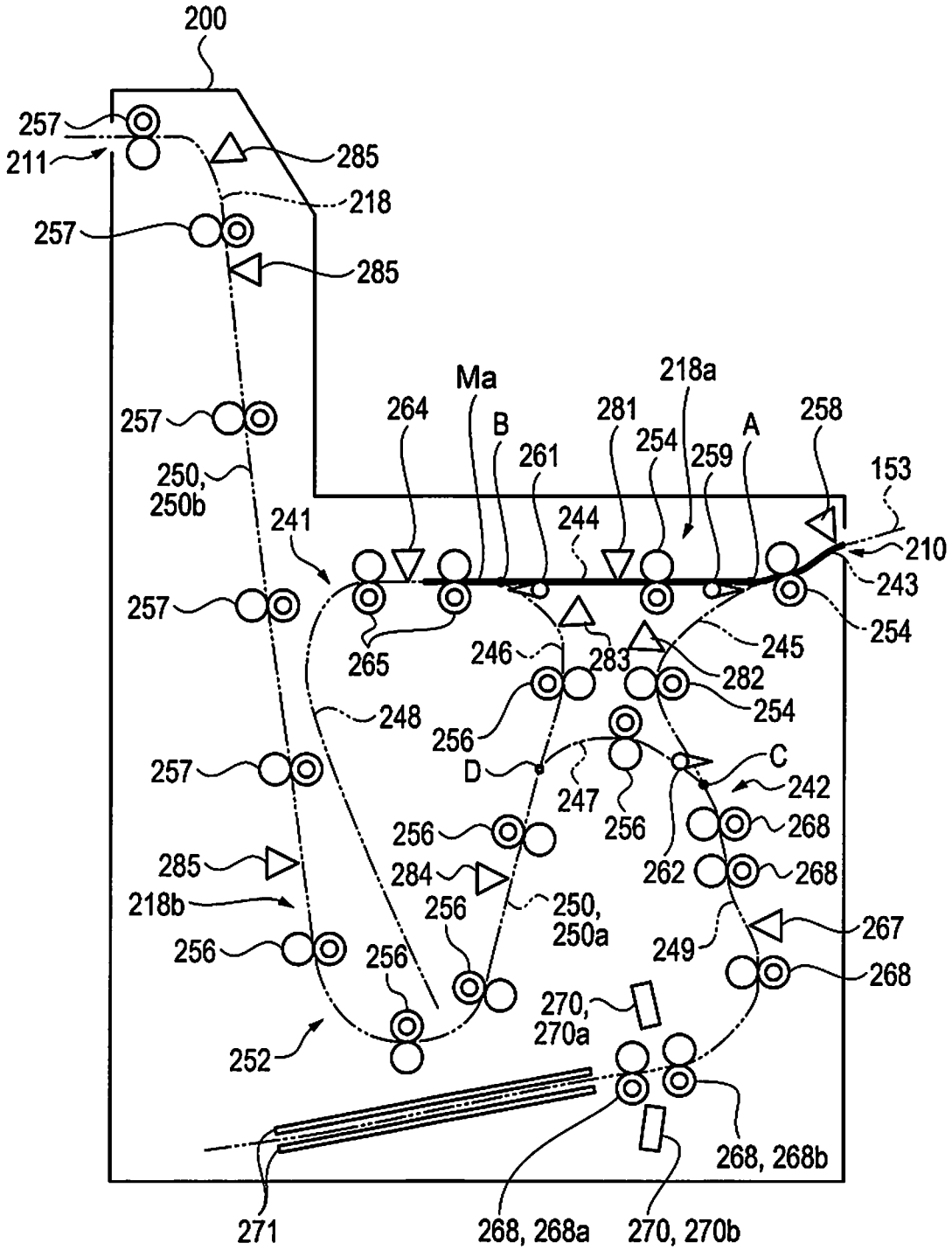
FIG. 4 is a schematic view illustrating an operating method of the printing apparatus.

Then, as illustrated in FIG. 4, the first paper sheet Ma which is transported along the third discharging path 153 at a pre-inversion speed is handed over to the inlet path 243 at the approximately same speed. When the introduction detecting unit 258 detects the leading end of the first paper sheet Ma, the controller 10 drives a solenoid such that the guide flap 259 is positioned at a first position P1. That is, the guide flap 259 guides the first paper sheet Ma toward the first branch path 244. Then, the leading end of the first paper sheet Ma which has been transported to the first connection point B comes into contact with the first restriction flap 261 so as to move the first restriction flap 261 against an urging force of an urging member. That is, the first restriction flap 261 is moved such that the downstream end of the first branch path 244 opens. Therefore, the first paper sheet Ma is fed into the first inversion path 248 at the pre-inversion speed by the pairs of first inverting rollers 265 being driven forwards. In addition, when the first paper sheet Ma passes through the first restriction flap 261, the first restriction flap 261 moves to a position at which the first restriction flap 261 closes the downstream end of the first branch path 244 from a position at which the first restriction flap 261 opens the downstream end of the first branch path 244.

Figure 5:
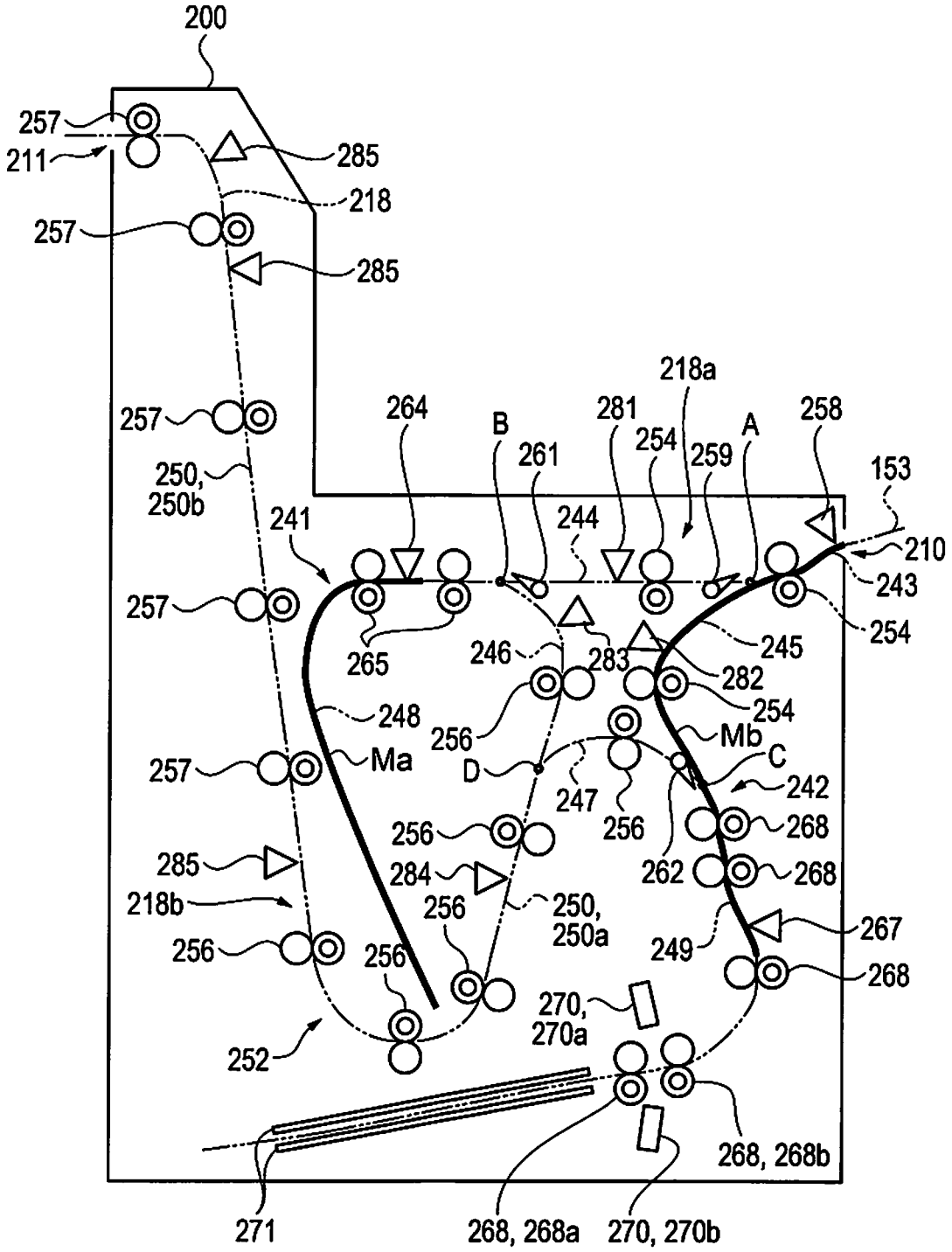
FIG. 5 is a schematic view illustrating the operating method of the printing apparatus.

As illustrated in FIG. 5, when the first inversion detecting unit 264 detects the trailing end of the first paper sheet Ma, the controller 10 switches a driving mode of the pair of first inverting rollers 265 from a forward driving-mode to a backward-driving mode. Then, the first inverting unit 241 fed the first paper sheet Ma to the first connection point B side from the first inversion path 248 at a post-inversion speed. In addition, at this time, the first restriction flap 261 guides the first paper sheet Ma to the first junction path 246. That is, in the first inverting unit 241, the first paper sheet Ma which fed from the first branch path 244 is fed to the first junction path 246 so that the orientation of the first paper sheet Ma is inverted (switch-back).

In addition, when the introduction detecting unit 258 detects the leading end of the second paper sheet Mb, the controller 10 drives the solenoid such that the position of the guide flap 259 is changed. That is, the controller 10 causes the guide flap 259 positioned at the first position P1 to move to a second position P2. Then, the guide flap 259 guides the second paper sheet Mb to the second branch path 245.

Figure 6:
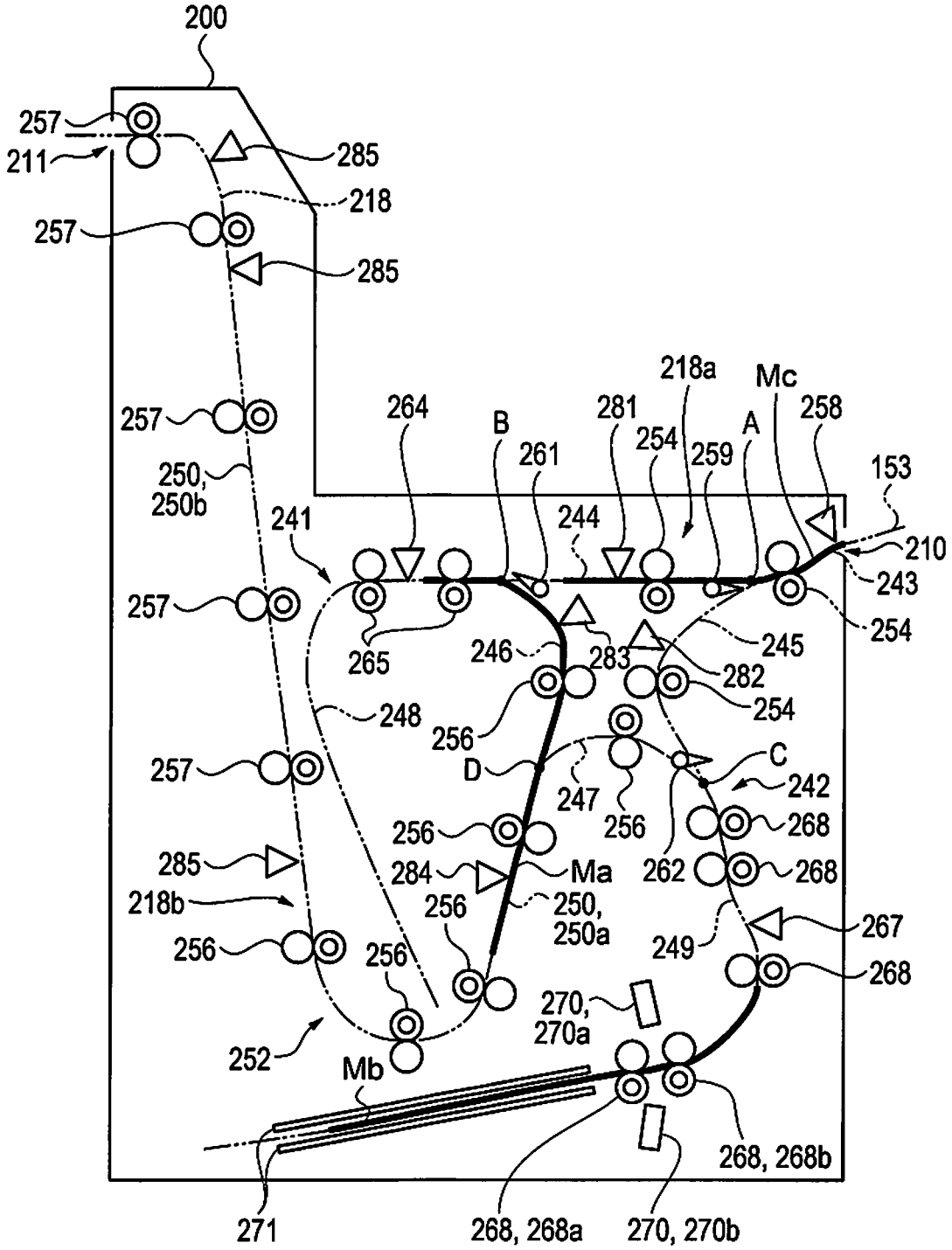
FIG. 6 is a schematic view illustrating the operating method of the printing apparatus.

As illustrated in FIG. 6, the first paper sheet Ma which has been inverted by the first inverting unit 241 is transported along the post-inversion path 218*b* at the post-inversion speed. When the first paper sheet Ma passes through the first connection point B, the controller 10 causes the pairs of first inverting rollers 265 to rotate forwards. In addition, when the second inversion detecting unit 267 detects the trailing end of the second paper sheet Mb, the controller 10 causes the pair of second inverting rollers 268 to rotate backwards. That is, in the second inverting unit 242, the second paper sheet Mb is inverted as in the first inverting unit 241 and is fed to the second junction path 247.

Furthermore, when the introduction detecting unit 258 detects the leading end of the third paper sheet Mc, the controller 10 drives the solenoid so that the position of the guide flap 259 is changed. Specifically, the controller 10 causes the guide flap 259 positioned at the second position P2 to move to the first position P1. That is, the guide flap 259 guides the transported paper sheet M to the first branch path 244 and the second branch path 245 alternately.

Figure 7:
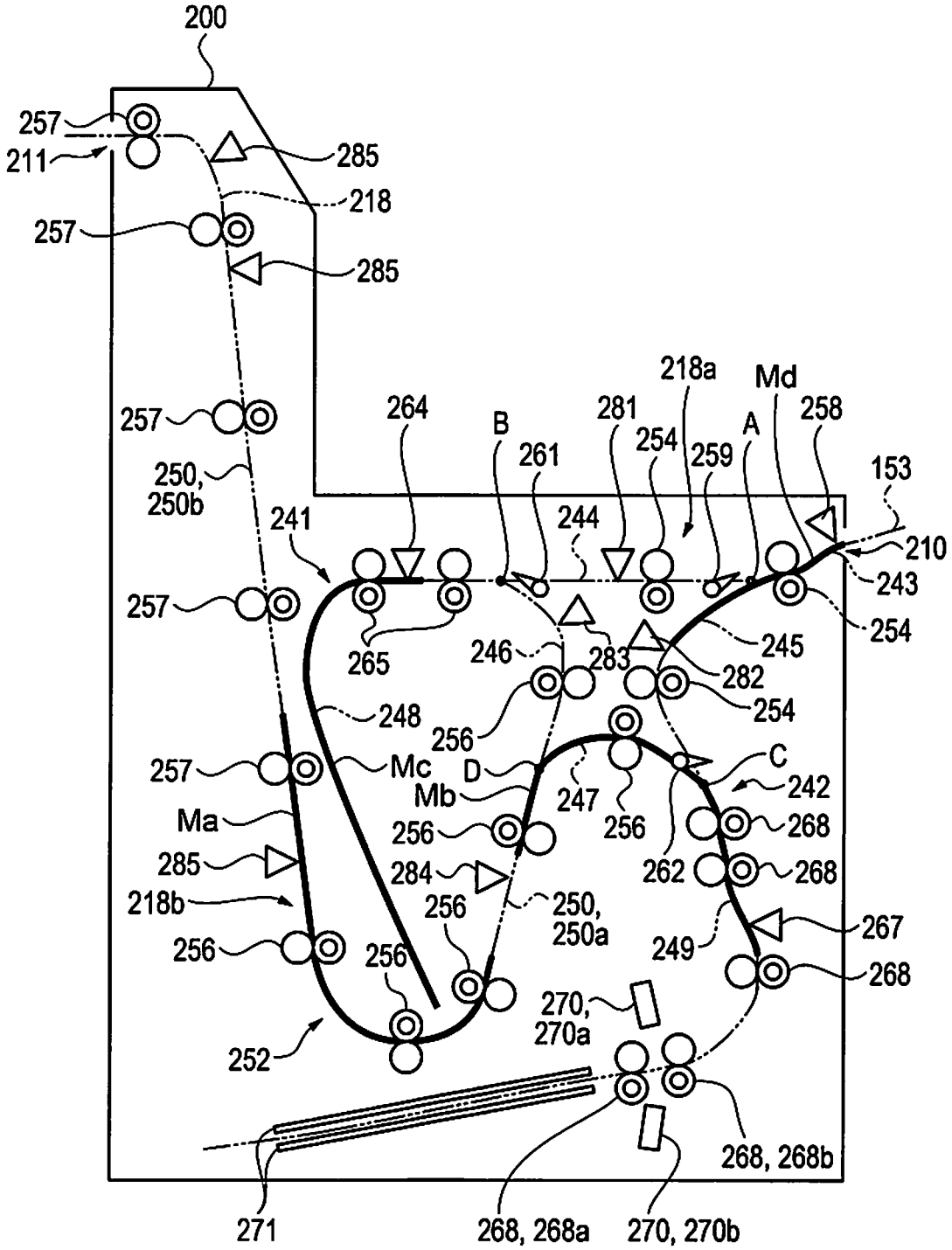
FIG. 7 is a schematic view illustrating the operating method of the printing apparatus.

As illustrated in FIG. 7, the second paper sheet Mb which is inverted in the second inverting unit 242 and is fed to the second junction path 247 is transported along the outlet path 250 while bypassing the junction point D. Note that, at this time, the intermediate transportation unit 252 transports the first paper sheet Ma and the second paper sheet Mb at the post-inversion speed which is lower than the pre-inversion speed. Therefore, a gap between the first paper sheet Ma and the second paper sheet Mb in the transportation direction becomes smaller than that in a case where the first paper sheet Ma and the second paper sheet Mb are transported along the pre-inversion path 218*a* at the pre-inversion speed.

In addition, when the first inversion detecting unit 264 detects the trailing end of the third paper sheet Mc, the controller 10 causes the pair of first inverting rollers 265 to rotate backwards so that the third paper sheet Mc is fed to the first junction path 246.

In addition, when the introduction detecting unit 258 detects the leading end of the fourth paper sheet Md, the controller 10 drives the solenoid so that the position of the guide flap 259 is changed to the second position P2.

Then, the intermediate unit 200 feeds the paper sheets M to the post processing unit 300 in such an order that the first paper sheet Ma, which enters the intermediate unit 200 first, is fed to the post processing unit 300 first. That is, the paper sheets M are fed to the post processing unit 300 after the paper sheets M are inverted in the intermediate unit 200. In addition, since the downstream side transportation unit 335 transports the paper sheet M at a processing speed which is higher than the post-inversion speed, a gap between the paper sheets M is expanded. The paper sheets M are sequentially transported to the stacker 328 and when a predetermined number of paper sheets M are mounted on the stacker 328, the processing unit 325 performs processing such as stapling and the paper sheets M are discharged to a discharging tray 331 with the pair of discharging rollers 329 being driven.

Next, an object to be achieved by using the post processing unit 300 according to the first embodiment will be described. As described above, in a case where the printing unit 100 is an ink jet printer that includes the recording head 111 ejecting ink in the form of liquid droplets, the paper sheet M on which an image has been printed in the printing unit 100 may curl (paper sheet may curve or paper sheet may be rolled up) due to absorption of ink (moisture), the drying of ink, and the like. Therefore, if the paper sheet M, which is mounted on the stacker 328 earlier, curls greatly, there is a possibility that stacking failure of the paper sheet M which is transported later occurs due to the curling of the paper sheet M which is mounted earlier. Furthermore, if ink (moisture) on the paper sheet M, on which an image has been printed in the printing unit 100, is insufficiently dried, moisture remains on a surface of the paper sheet M and thus the friction resistance of the surface of the paper sheet M becomes great. Therefore, in a case where the paper sheets M on each of which an image is printed in the printing unit 100 (ink jet printer) are sequentially mounted on the stacker 328, if the friction resistance of a surface of the paper sheet M which is mounted earlier becomes great, the paper sheet M which is transported later is caught on the paper sheet M which is mounted earlier and alignment failure in which end portions of the paper sheets M are not aligned may occur.

Furthermore, the mechanism of occurrence of the curling of the paper sheet M will be described in detail. The paper sheet M in the first embodiment contains cellulose as a main component and is formed through hydrogen bonding between cellulose. Therefore, if ink is applied to one surface of the paper sheet M by the printing unit 100, a hydrogen bond between cellulose is divided due to absorption of ink. As a result, a gap between cellulose is expanded and the one surface of the paper sheet M to which ink is applied becomes more likely to expand than the other surface which is opposite to the one surface of the paper sheet M. Therefore, in a case where the paper sheet M is mounted with the one surface facing a gravity direction (downward), the paper sheet M curls (first curling effect) to have a convex shape in the gravity direction.

In addition, if ink absorbed by the paper sheet M starts to be dried after the first curling effect, cellulose is freely bonded through hydrogen bonding and the gap between cellulose becomes short. As a result, the one surface of the paper sheet M to which ink is applied shrinks more than the other surface. Therefore, in a case where the paper sheet M is mounted with the one surface facing the gravity direction, the paper sheet M curls (second curling effect) to have a concave shape in the gravity direction, contrary to the case of the first curling effect (convex shape in direction opposite to gravity direction).

In addition, the paper sheet M curls not only in simplex printing but also in duplex printing. That is, the paper sheet M is likely to curl in a case where the printing duty of the one surface of the paper sheet M and the printing duty of the other surface are different from each other. Particularly, the curling of the paper sheet M occurs frequently in a case where a difference between the printing duty of the one surface of the paper sheet M and the printing duty of the other surface is equal to or greater than a predetermined value (for example, approximately 30% or more). Note that, "duty" is a value calculated from duty (%)=number of actually recorded dots/(vertical resolution×horizontal resolution)×100 (where "number of actually recorded dots" is the number of actually recorded dots per unit area and each of "vertical resolution" and "horizontal resolution" is a resolution per unit area). In addition, a difference in printing duty between both surfaces of the paper sheet M means a difference in amount of moisture between both surfaces (one surface and other surface) of the paper sheet M.

Therefore, the intermediate unit 200 is provided with the drying unit 270 which suppresses the paper sheet M being insufficiently dried and deformation (curling) of the paper sheet M which is mounted on the stacker 328 of the post processing unit 300. With the drying unit 270, it is possible to suppress stacking failure which is caused by alignment failure due to a high friction resistance of the paper sheet M mounted on the stacker 328 or caused by the curling of the paper sheet M.

Drying Unit

Next, the operation of the drying unit 270 provided in the intermediate unit 200 will be described.

Figure 8:
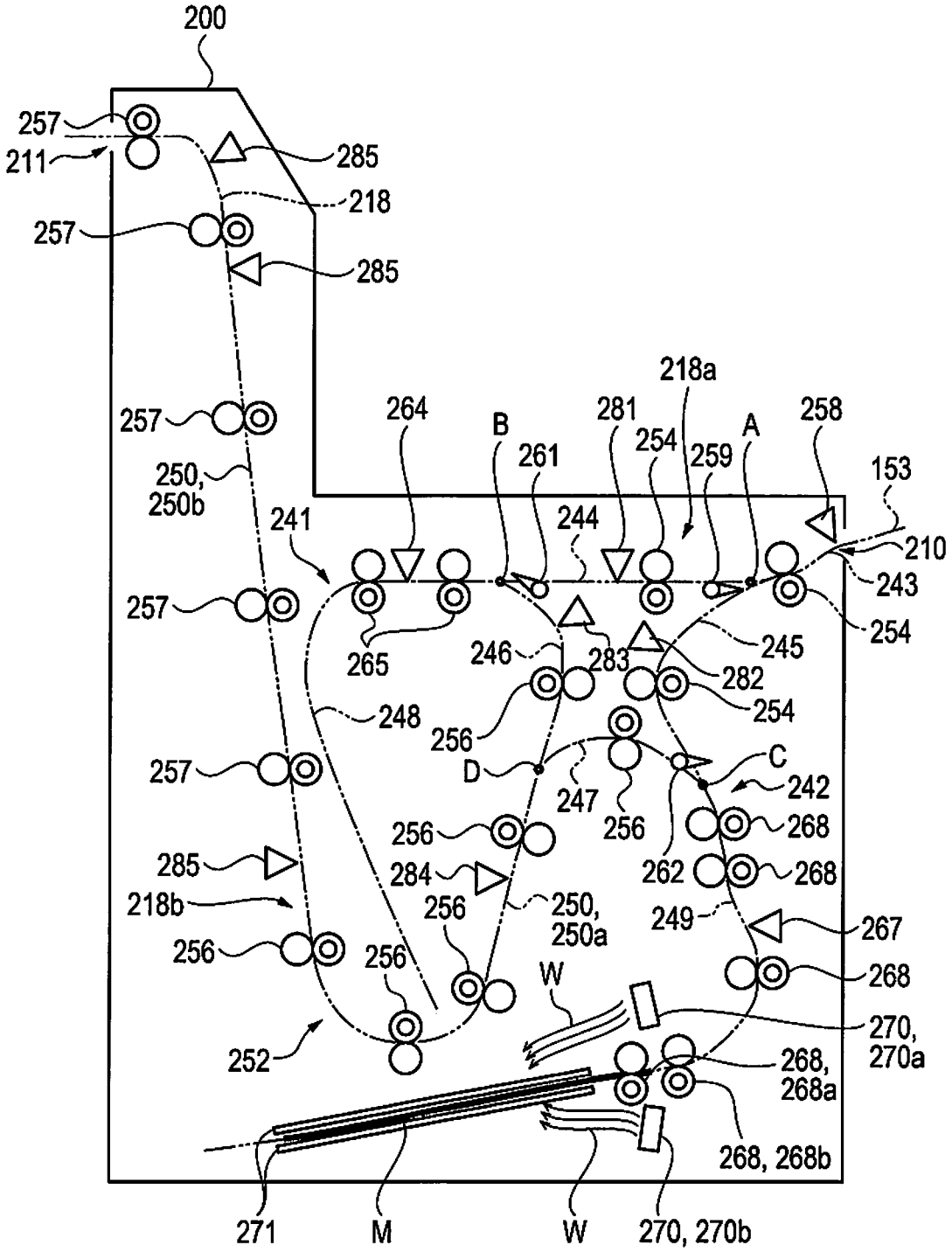
FIG. 8 is a schematic view for explaining the operation of a drying unit in an intermediate unit according to a first embodiment.

FIG. 8 is a schematic view for explaining the operation of the drying unit.

According to the printing duty as printing data, the paper sheet M which needs to be dried is fed to the second inversion path 249 in which the drying unit 270 is provided. After the paper sheet M enters the second inversion path 249, as illustrated in FIG. 8, a portion of the paper sheet M, which is closer to the trailing end of the paper sheet M than to the leading end of the paper sheet M in a direction in which the paper sheet M enters the second inversion path 249, is held by the pair of first rollers 268*a* which constitutes the first holding unit 269*a* (refer to FIG. 3). Thereafter, the drying unit 270 is driven according to the printing duty and the air blower of the drying unit 270 sends air W so as to accelerate the drying of the paper sheet M. Since the air is applied to the paper sheet M which has a flat shape while being guided by the guide plate 271, it is possible to easily suppress deformation such as the curling of the paper sheet M using air pressure.

Next, another configuration of drying units 90 provided in the intermediate unit 200 will be described with reference to FIGS. 9 to 12.

Figure 9:
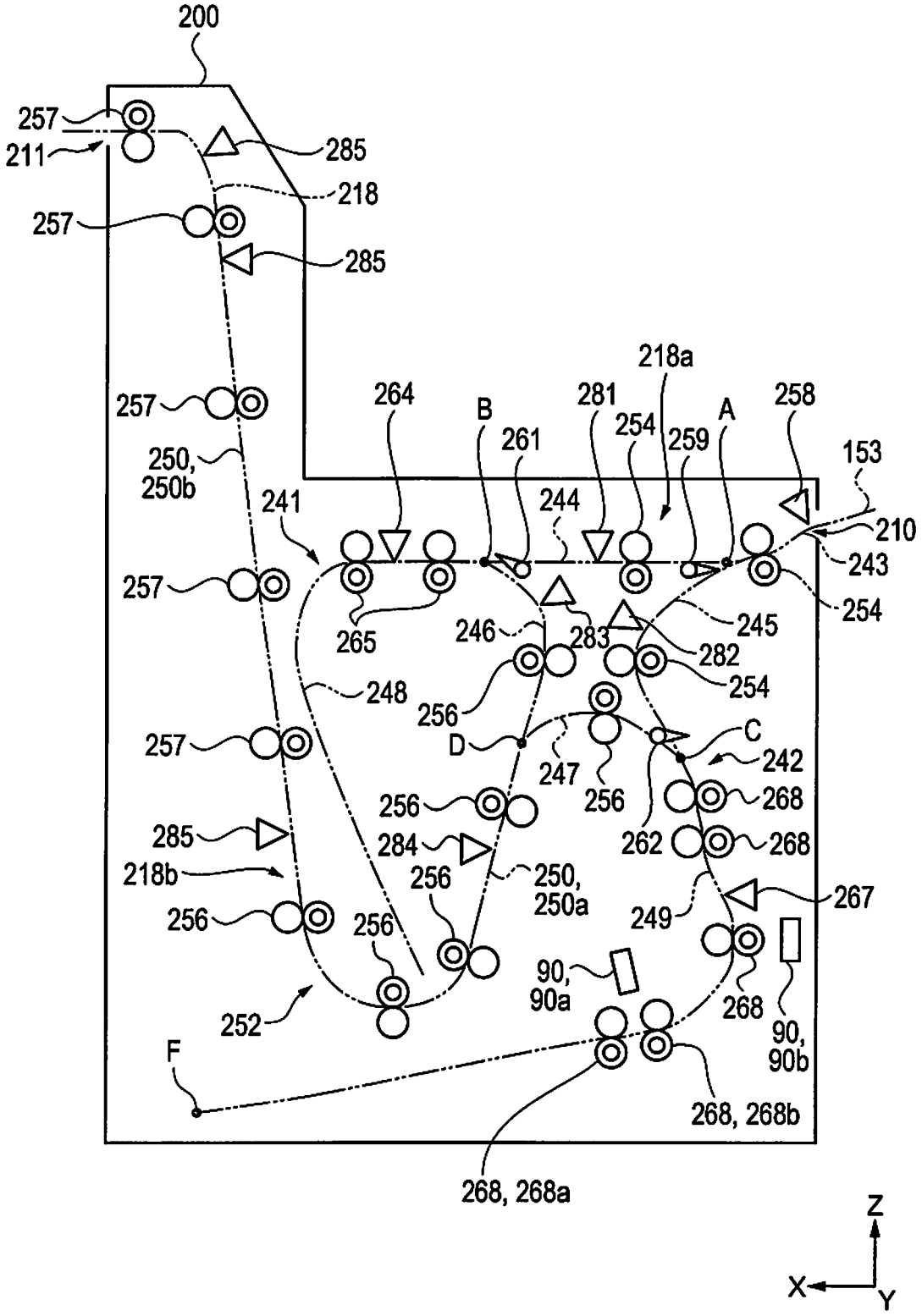
FIG. 9 is a configuration view illustrating another configuration of a drying unit provided in the intermediate unit.
Figure 10:
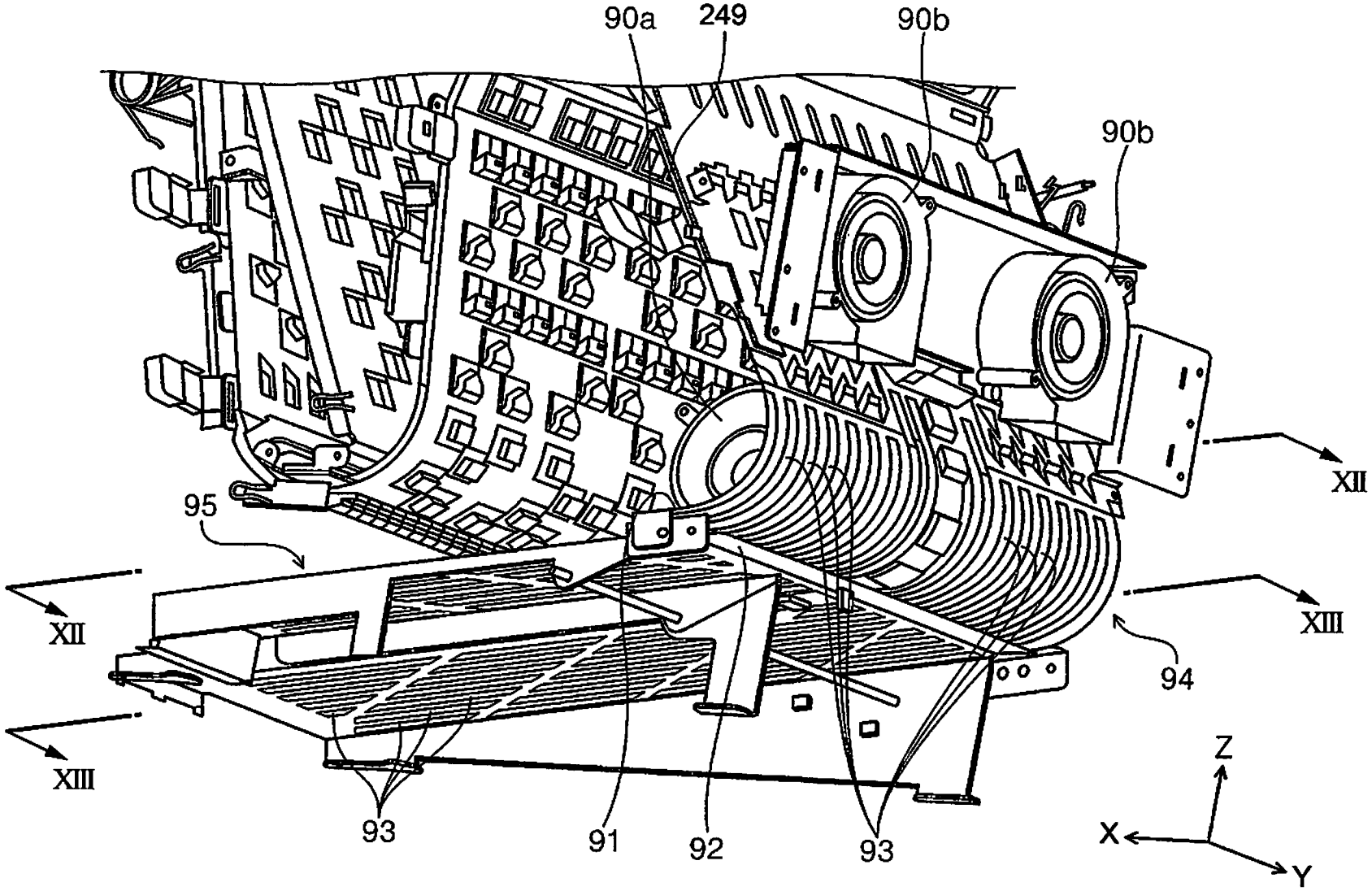
FIG. 10 is an enlarged perspective view illustrating the vicinity of a second inversion path in the other configuration of the drying unit provided in the intermediate unit.
Figure 11:
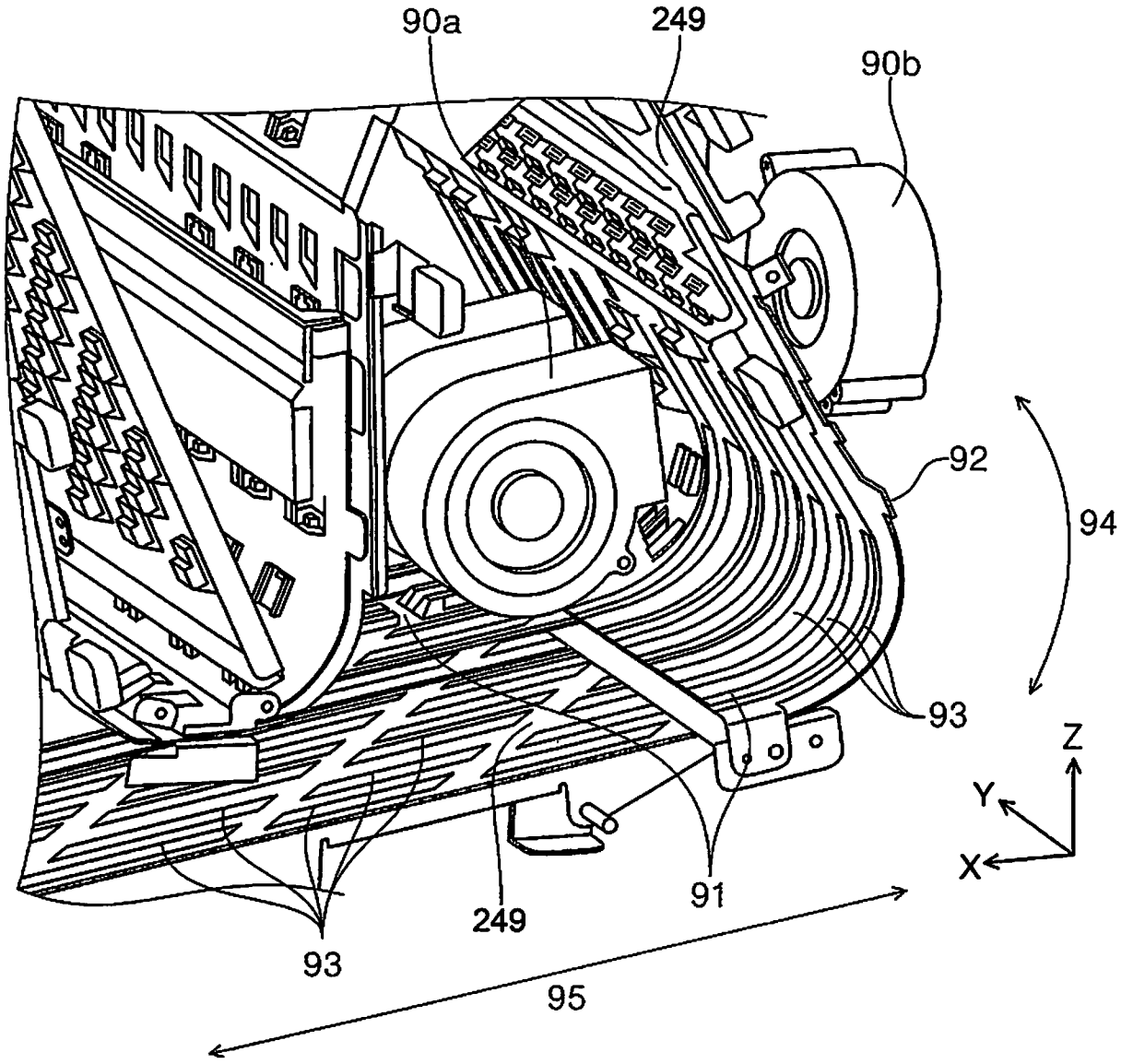
FIG. 11 is a view illustrating the same area as FIG. 10 as seen from a different angle.
Figure 12:
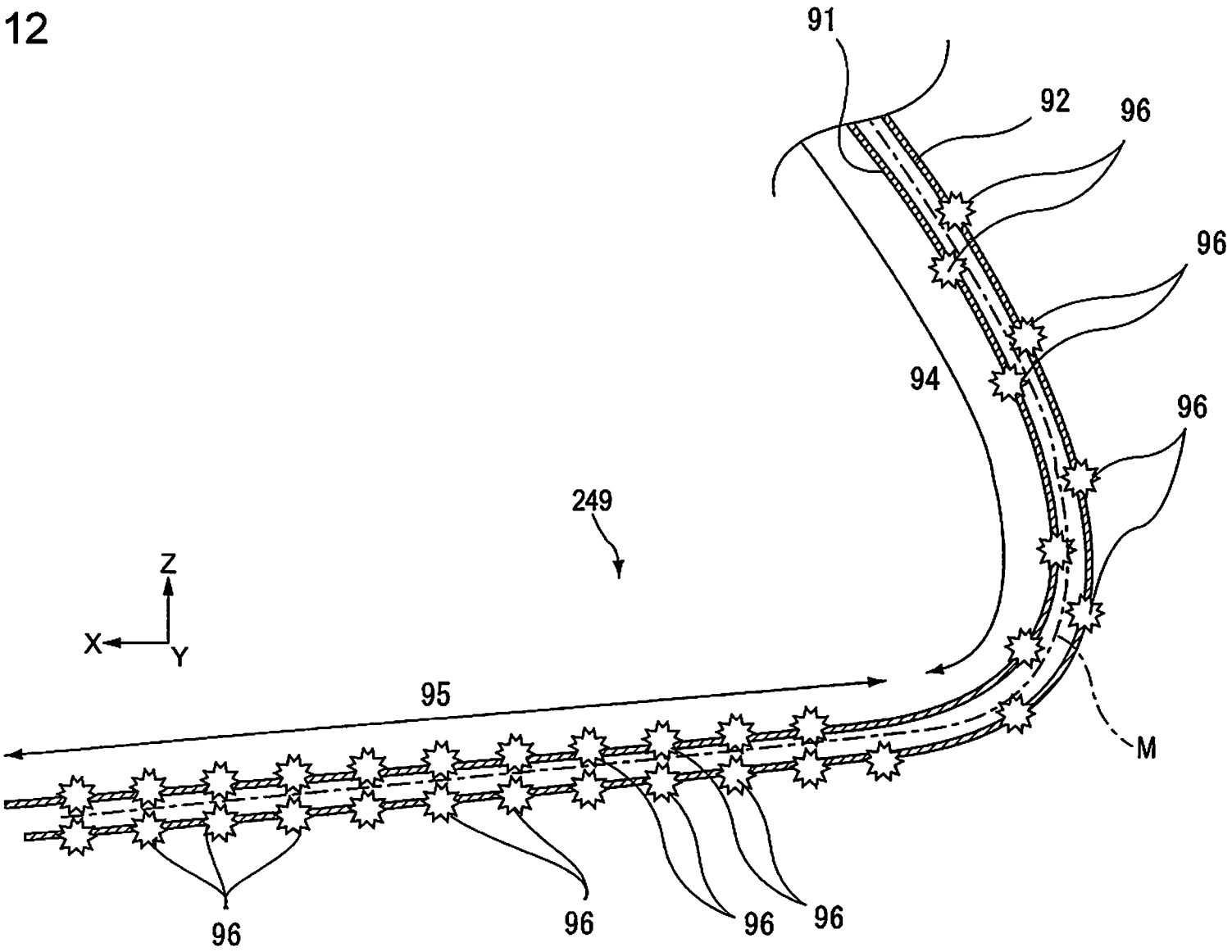
FIG. 12 is a sectional view illustrating the second inversion path which is taken along line XII-XII in FIG. 10.
Figure 13:
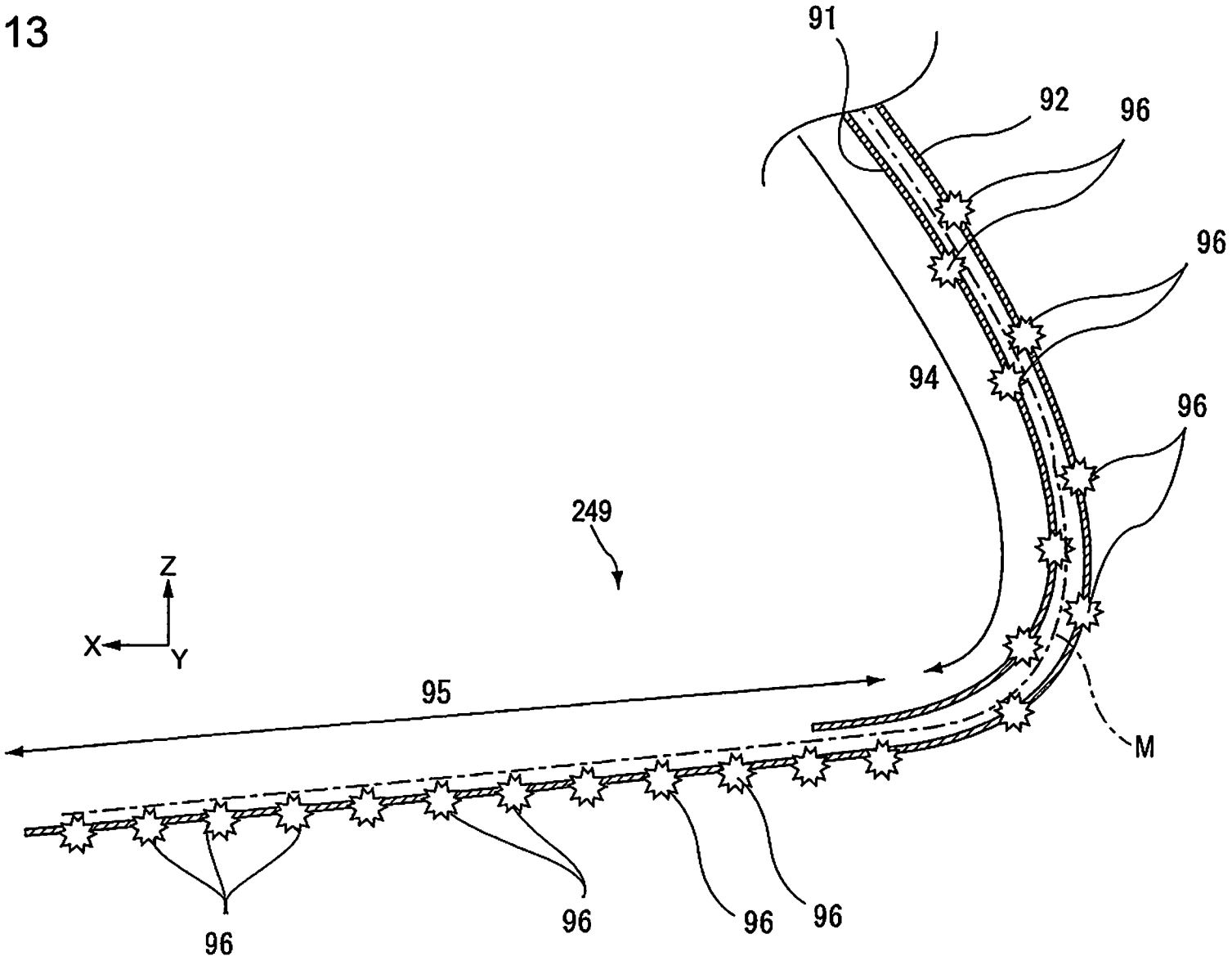
FIG. 13 is a sectional view illustrating the second inversion path which is taken along line XIII-XIII in FIG. 10.

FIG. 9 is a configuration view illustrating another configuration of the drying units provided in the intermediate unit, FIG. 10 is an enlarged perspective view illustrating the vicinity of the second inversion path in the other configuration of the drying units provided in the intermediate unit, and FIG. 11 is a view illustrating the same area as FIG. 10 as seen from a different angle. FIG. 12 is a sectional view illustrating the second inversion path which is taken along line XII-XII in FIG. 10 and FIG. 13 is a sectional view illustrating the second inversion path which is taken along line XIII-XIII in FIG. 10.

Note that, in an XYZ coordinate system in each drawing, an X axis direction is the transportation direction of the recording medium (paper sheet M) in the transportation path in the intermediate unit 200 and is an apparatus width direction, a Y axis direction is the width direction of the recording medium (paper sheet M) and is an apparatus depth direction, and a Z axis direction is an apparatus height direction.

The intermediate unit 200 is provided with two drying units 90 (first drying unit 90*a* and second drying unit 90*b*) which are arranged in the X axis direction with the second inversion path 249 interposed therebetween. In the first embodiment, each of the drying units 90 (90*a* and 90*b*) is configured to include an air blower and the air blower sends air toward the second inversion path 249 (refer to FIGS. 10 and 11).

The second inversion path 249 includes an inner path surface 91 which is positioned on the inner side of a curve formed by the second inversion path 249 and an outer path surface 92 which is positioned on the outer side of the curve formed by the second inversion path 249. The first drying unit 90*a* is disposed to send air toward the inner path surface 91 and the second drying unit 90*b* is disposed to send air toward the outer path surface 92.

Each of the outer path surface 92 and the inner path surface 91 is provided with a plurality of slit portions 93. Each slit portion 93 is elongated in the transportation direction (X axis direction). Since the outer path surface 92 and the inner path surface 91 are provided with the slit portions 93, an effect of drying the paper sheet M using air sent from the first drying unit 90*a* and the second drying unit 90*b* is improved.

As illustrated in FIG. 9, the second inversion path 249 includes a curved portion 94 (FIGS. 10 and 11) which curves once in the transportation direction from a branch point C to the second inversion path 249 and a linear portion 95 which linearly extends toward an end portion F. In addition, in the linear portion 95, the inner path surface 91 is provided only on the central portion in the width direction (Y axis direction) which intersects the transportation direction of the paper sheet M (X axis direction).

As illustrated in FIG. 12, in the vicinity of the central portion in the above-described width direction of the second inversion path 249, the paper sheet M is interposed between both of the outer path surface 92 and the inner path surface 91 over an area from the curved portion 94 to the linear portion 95. According to this configuration, it is possible to achieve stable transportation of the paper sheet M in the second inversion path 249 with the paper sheet M being retained over the area from the curved portion 94 to the linear portion 95.

Meanwhile, in the curved portion 94, the end portions of the paper sheet M in the above-described width direction are interposed between both of the outer path surface 92 and the inner path surface 91 in the curved portion 94. However, in the linear portion 95, the end portions of the paper sheet M in the above-described width direction are supported only by the outer path surface 92, as illustrated in FIG. 13. According to this configuration, it is possible to easily perform a jam fixing process or the like in the second inversion path 249.

Note that, in FIGS. 12 and 13, each reference numeral 96 denotes a jagged roller, which includes a plurality of protrusions on a peripheral surface thereof and is configured to come in point contact with the paper sheet M.

According to this configuration, it is possible to accelerate the drying of the paper sheet M and to easily suppress deformation such as the curling of the paper sheet M.

Figure 14:
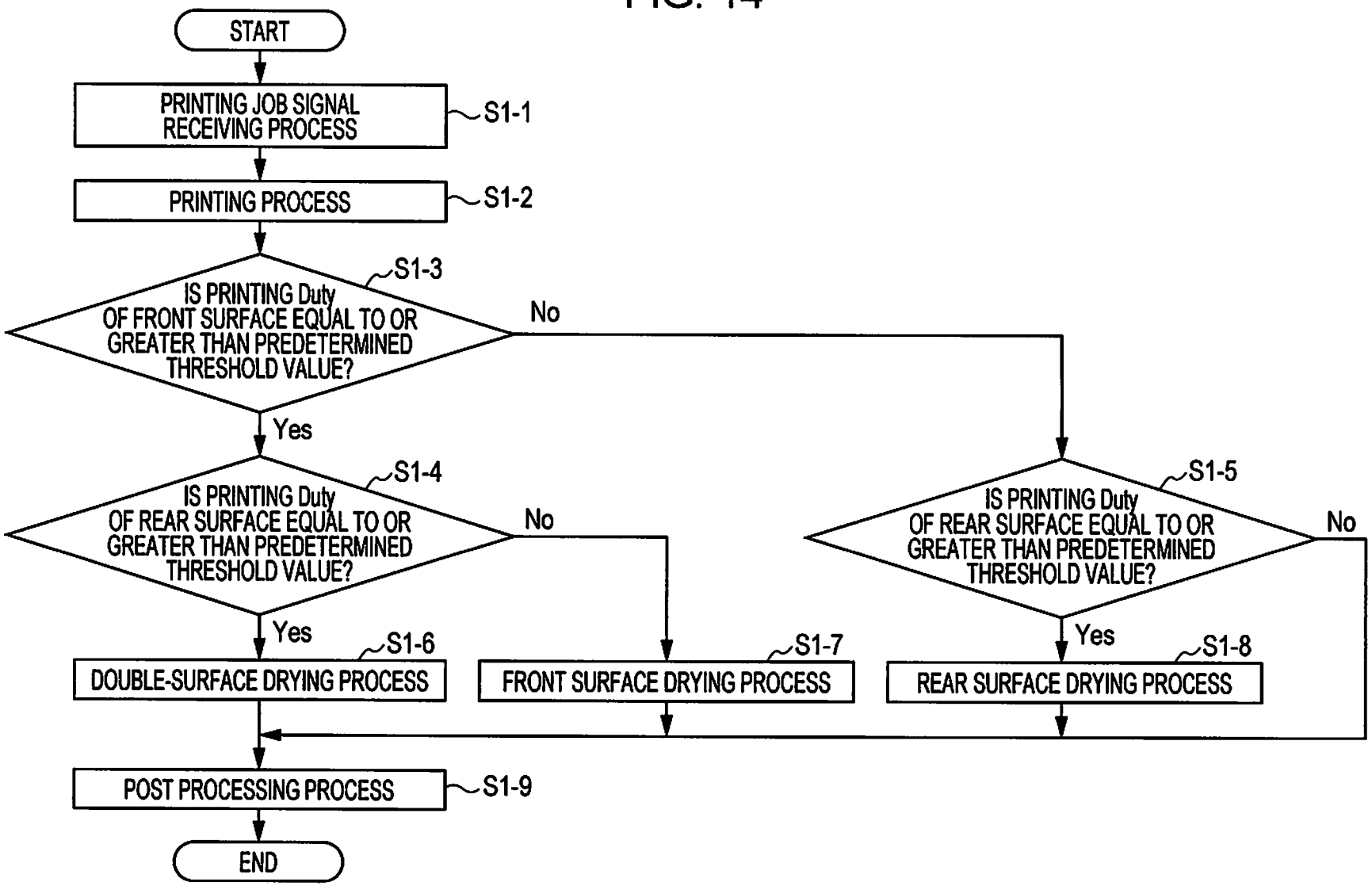
FIG. 14 is a flowchart illustrating an operating method of a printing apparatus which includes the intermediate unit according to the first embodiment.

Operating Method of Printing Apparatus Including Drying Unit in Intermediate Unit Next, the operating method of the printing apparatus 1 including the drying unit 270 in the intermediate unit 200 will be described. FIG. 14 is a flowchart illustrating an operating method of the printing apparatus which includes the drying unit in the intermediate unit. Note that, in the following description, one surface of the paper sheet M will be referred to as a front surface and the other surface of the paper sheet M which faces the one surface of the paper sheet M will be referred to as a rear surface.

First, a printing job signal from the controller 10 is received (Step S1-1). Next, an image is printed on the paper sheet M in the printing unit 100 on the basis of the printing job signal (Step S1-2). The paper sheet M on which the image has been printed is transported to the intermediate unit 200 which includes the transportation path 218.

Thereafter, in the inlet path 243 of the intermediate unit 200, one of the first inversion path 248 which is not provided with the drying unit 270 and the second inversion path 249 which is provided with the drying unit 270 is selected according to the printing duty as the printing data from the controller 10. That is, when the printing duty is equal to or greater than a predetermined threshold value (for example, 50%), the paper sheet M is fed to the second inversion path 249 which is provided with the drying unit 270 and the drying unit 270 is driven so that the paper sheet M is dried. In addition, in a case where the printing duty is smaller than the predetermined threshold value (for example, 50%), the paper sheet M is fed to the first inversion path 248 which is not provided with the drying unit 270 since the paper sheet M does not need to be dried. That is, the paper sheet M, in which a difference in amount of moisture between the front and rear surfaces of the paper sheet M which is based on the printing duty is equal to or greater than the predetermined threshold value, is transported along the second inversion path 249 which is provided with the drying unit 270 and the paper sheet M in which a difference in amount of moisture between the front and rear surfaces of the paper sheet M which is based on the printing duty is smaller than the predetermined threshold value is transported along the first inversion path 248 which is not provided with the drying unit 270.

In Step S1-3, it is determined whether the printing duty of the front surface is equal to or greater than the predetermined threshold value. In a case where the result of determination in Step S1-3 is "Yes", the process proceeds to Step S1-4 and in a case where the result of determination in Step S1-3 is "No", the process proceeds to Step S1-5.

Both of Step S1-4 and Step S1-5 are a step of determining whether the printing duty of the rear surface is equal to or greater than the predetermined threshold value and in a case where the result of determination in Step S1-4 is "Yes", the process proceeds to Step S1-6 and in a case where the result of determination in Step S1-4 is "No", the process proceeds to Step S1-7.

In addition, in a case where the result of determination in Step S1-5 is "Yes", the process proceeds to Step S1-8 and in a case where the result of determination in Step S1-5 is "No", since the drying process for the paper sheet M is omitted (the paper sheet M does not need to be dried), the paper sheet M is switched back at a position on the upstream side of the drying unit 270 in a direction in which the paper sheet M enters an inversion path, the paper sheet M is transported to the post processing unit 300 after being inverted via the first inversion path 248, and the process proceeds to Step S1-9. Note that, in a case where the drying process for the paper sheet M is omitted, the paper sheet M may be inverted by using the second inversion path 249 which is provided with the drying unit 270. In this case, if the paper sheet M is switched back at a position on the upstream side of the drying unit 270 in a direction in which the paper sheet M enters the second inversion path 249, it is possible to reduce the transportation distance and the transportation time and thus it is possible to perform an inverting process at a high speed.

In Step S1-6, the paper sheet M is fed to the second inversion path 249 which is provided with the drying unit 270, both surfaces of the paper sheet M are dried by the drying unit 270, the paper sheet M is transported to the post processing unit 300 after being inverted while being switched back in the second inversion path 249, and the process proceeds to Step S1-9. At this time, the first drying unit 270*a* and the second drying unit 270*b* are controlled independently of each other according to the printing duties of both surfaces of the paper sheet M. That is, since drying conditions (air blowing intensity or air blowing time) of the first drying unit 270*a* and the second drying unit 270*b* are adjusted according to the printing duties of the front and rear surfaces, it is possible to approximately equalize the degree of drying of the front surface of the paper sheet M and the degree of drying of the rear surface of the paper sheet M and thus it is possible to suppress deformation of the paper sheet M which is caused by the second curling effect or the like.

In Step S1-7, since the front surface needs to be dried, the paper sheet M is fed to the second inversion path 249, the front surface of the paper sheet M is dried by the drying unit 270, the paper sheet M is transported to the post processing unit 300 after being inverted while being switched back in the second inversion path 249, and the process proceeds to Step S1-9.

In Step S1-8, since the rear surface needs to be dried, the paper sheet M is fed to the second inversion path 249, the rear surface of the paper sheet M is dried by the drying unit 270, the paper sheet M is transported to the post processing unit 300 after being inverted while being switched back in the second inversion path 249, and the process proceeds to Step S1-9.

In Step S1-9, the transported paper sheet M is transported to the stacker 328 via the guiding unit 330 and is mounted on the stacker 328 with one end sides of the paper sheets M being aligned. Thereafter, the processing unit 325 performs post processing such as the punching process of punching a punched hole through the paper sheet M, the stapling process of binding a predetermined number of paper sheets M, and the shifting process of shifting the position of the paper sheet M in the width direction thereof per one paper sheet M or per one bundle of paper sheets M for adjustment with respect to the paper sheet M mounted on the stacker 328.

As described above, according to the printing apparatus 1 which includes the drying unit 270 in the first embodiment, it is possible to achieve the following effect.

Since the transportation path of the intermediate unit 200 is provided with the drying unit 270 that accelerates the drying of the paper sheet M, it is possible to sufficiently dry the paper sheet M by using the drying unit 270 in the middle of transportation and thus it is possible to provide the intermediate unit 200 that can suppress the curling of the paper sheet M and can decrease the friction resistance of the paper sheet M which depends on moisture of ink. Therefore, it is possible to suppress stacking failure which occurs due to the curling of the paper sheet M, on which printing has been performed, when the post processing is performed on the paper sheet M discharged from the intermediate unit 200 and it is possible to suppress alignment failure which occurs due to a high friction resistance.

In addition, since the transportation path 218 is provided with the inversion paths 248 and 249, the paper sheet M can be inverted upside down in the middle of transportation.

In addition, since the drying unit 270 is provided in the second inversion path 249 in which a long region in which the paper sheet M can have a straight shape can be secured, it is possible to reduce the size of the intermediate unit 200.

In addition, since the drying unit 270 is provided in the second inversion path 249 which is one of the plurality of inversion paths 248 and 249, it is possible to reduce the size of the intermediate unit 200 and to achieve power saving.

In addition, since one of the plurality of inversion paths 248 and 249 is selected according to the printing duty as the printing data for the paper sheet M, in the intermediate unit 200, the paper sheet M can be inverted efficiently.

In addition, since it is possible to dry the paper sheet M by driving the drying unit 270 if a difference in amount of moisture between the front and rear surfaces of the paper sheet M which is based on the printing data is equal to or greater than the predetermined threshold value, it is possible to suppress the curling of the paper sheet M and thus it is possible to decrease the friction resistance of the paper sheet M which depends on moisture of ink.

In addition, since it is possible to dry the paper sheet M by transporting the paper sheet M, in which a difference in amount of moisture between the front and rear surfaces of the paper sheet M which is based on the printing data is equal to or greater than the predetermined threshold value, to the second inversion path 249 which is provided with the drying unit 270, it is possible to suppress the curling of the paper sheet M and thus it is possible to decrease the friction resistance of the paper sheet M which depends on moisture of ink.

In addition, since the first drying unit 270*a* that faces one surface of the paper sheet M and the second drying unit 270*b* that faces the other surface of the paper sheet M are provided, it is possible to dry both surfaces of the paper sheet M at the same time and thus it is possible to further accelerate the drying of the paper sheet M.

In addition, since the first drying unit 270*a* and the second drying unit 270*b* are controlled independently of each other according to the printing duty, it is possible to achieve a good balance between the degree of drying of one surface of the paper sheet M and the degree of drying of the other surface and to suppress deformation of the paper sheet M which occurs due to the second curling effect or the like.

In addition, since the drying unit 270 includes the air blower and the paper sheet M is dried with the air blower sending air to the paper sheet M, it is possible to easily suppress deformation such as the curling of the paper sheet M using the air pressure of the sent air. In addition, since no heat source is used, it is possible to achieve power saving in the intermediate unit 200.

In addition, since the first holding unit 269*a* which is on the downstream side of the air blower of the drying unit 270 holds a portion of the paper sheet M which is close to the trailing end of the paper sheet M, it is possible to apply air to the paper sheet M and to secure a long region, in which the paper sheet M can have a straight shape. Therefore, it is possible to dry the paper sheet M in a state where the paper sheet M has a straight shape and thus it is possible to easily suppress deformation such as the curling of the paper sheet M.

In addition, since the paper sheet M for which a drying process is omitted is switched back at a position on the upstream side of the drying unit 270, it is possible to reduce the transportation distance and the transportation time and thus it is possible to perform the inverting process at a high speed.

Since it is possible to sufficiently dry the paper sheet M, on which printing has been performed, by using the drying unit 270 provided in the transportation path 218, it is possible to suppress the curling of the paper sheet M and thus it is possible to decrease the friction resistance of the paper sheet M which depends on moisture of ink. Therefore, it is possible to provide the post processing device 2 with which it is possible to suppress stacking failure which occurs due to the curling of the paper sheet M, on which printing has been performed, when the post processing is performed on the paper sheet M and it is possible to suppress alignment failure which occurs due to a high friction resistance.

In addition, since the transportation path 218 is provided with the inversion paths 248 and 249, it is possible to provide the post processing device 2 in which the paper sheet M can be inverted upside down in the middle of transportation.

In addition, since it is possible to sufficiently dry the paper sheet M, on which printing has been performed, by using the drying unit 270 provided in the transportation path 218, it is possible to suppress the curling of the paper sheet M and thus it is possible to decrease the friction resistance of the paper sheet M which depends on moisture of ink. Therefore, it is possible to provide the printing apparatus 1 with which it is possible to suppress stacking failure which occurs due to the curling of the paper sheet M, on which printing has been performed, when the post processing is performed on the paper sheet M and it is possible to suppress alignment failure which occurs due to a high friction resistance.

Second Embodiment

Figure 15:
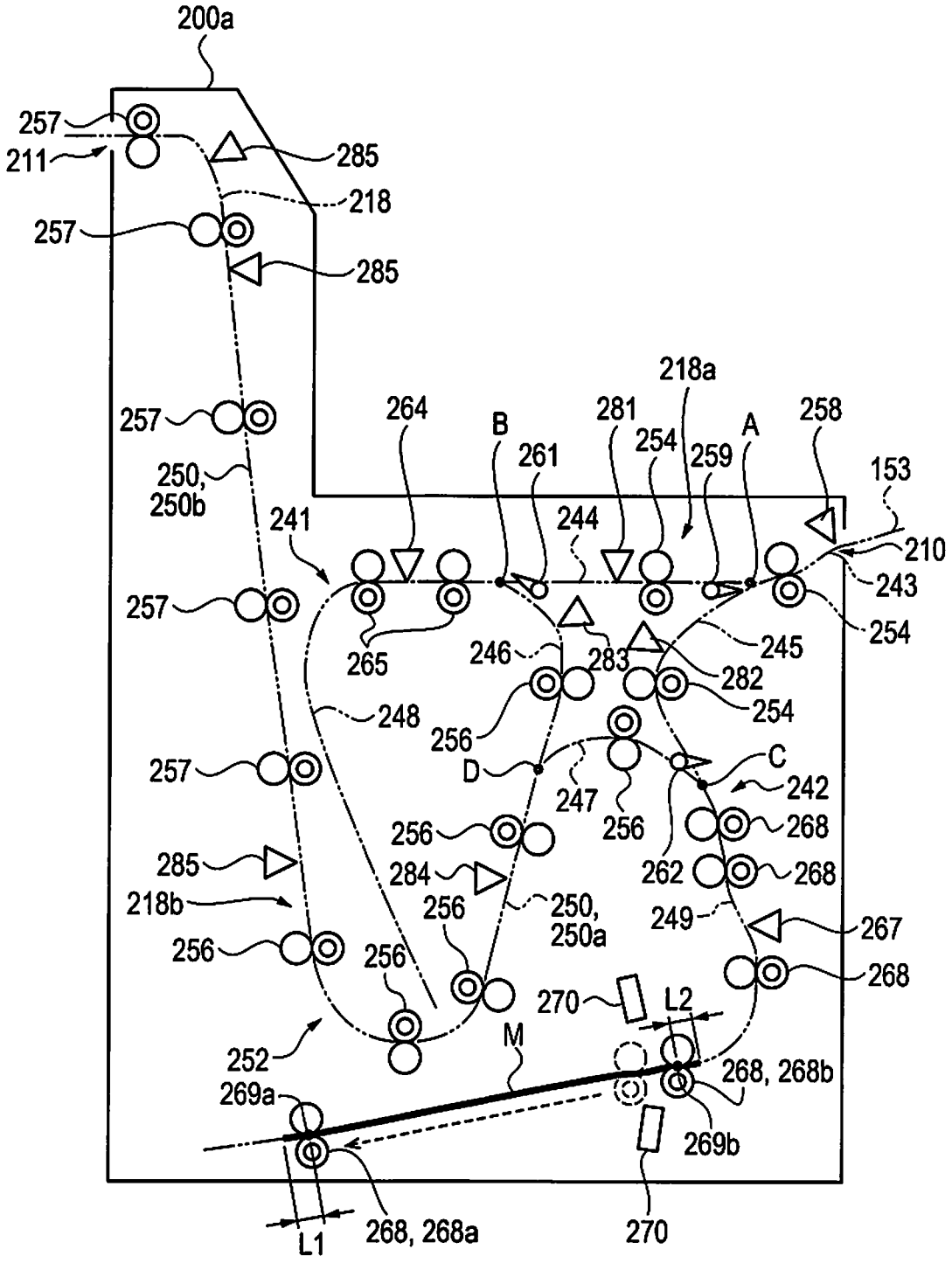
FIG. 15 is a schematic view for explaining the operation of a tensile force applying mechanism of an intermediate unit according to a second embodiment.

Next, a tensile force applying mechanism of an intermediate unit 200*a* according to a second embodiment of the invention will be described. FIG. 15 is a schematic view for explaining the operation of the tensile force applying mechanism of the intermediate unit according to the second embodiment. Note that, the same components as in the first embodiment are given the same reference numerals and description thereof will not be repeated.

The intermediate unit 200*a* according to the second embodiment is different from the intermediate unit 200 according to the first embodiment in that the intermediate unit 200*a* does not include the guide plate 271 that guides the paper sheet M at the time of the drying process and includes the tensile force applying mechanism.

Tensile Force Applying Mechanism

The intermediate unit 200*a* is provided with a tensile force applying mechanism that applies a tensile force to the paper sheet M so as to suppress deformation such as the curling of the paper sheet M. The tensile force applying mechanism is provided in the second inversion path 249 as illustrated in FIG. 15. The tensile force applying mechanism is constituted by the pair of first rollers 268*a* which includes the first holding unit 269*a* nipping and holding one end of the paper sheet M, the pair of second rollers 268*b* which includes the second holding unit 269*b* nipping and holding the other end of the paper sheet M, and a displacement device (not shown) which changes the relative position of the pair of first rollers 268*a* with respect to the pair of second rollers 268*b* along the second inversion path 249 (transportation path 218). Note that, since each of the first holding unit 269*a* and the second holding unit 269*b* is constituted by one pair of rollers that nips the paper sheet M, it is possible to hold the paper sheet M by stopping rotation of the rollers after the paper sheet M is nipped.

The paper sheet M, which has been supplied to the second inversion path 249 including the tensile force applying mechanism, passes through the pair of second rollers 268*b* being rotated and is nipped by the pair of first rollers 268*a* being rotated. Next, when the position of the pair of first rollers 268*a* with respect to the paper sheet M reaches a holding position at which the paper sheet M is held (a position which is separated from the leading end of the paper sheet M by a distance L1), rotation of the pair of first rollers 268*a* is stopped so that the first holding unit 269*a* holds the paper sheet M. Thereafter, the displacement device (not shown) moves the pair of first rollers 268*a* in a direction in which the paper sheet M enters the inversion path (direction denoted by broken arrow) with the pair of second rollers 268*b* being rotated so that the relative position of the pair of first rollers 268*a* with respect to the pair of second rollers 268*b* is changed.

Next, when the paper sheet M reaches a holding position at which the pair of second rollers 268*b* holds the paper sheet M (a position which is separated from the trailing end of the paper sheet M by a distance L2), rotation of the pair of second rollers 268*b* is stopped so that the second holding unit 269*b* holds the paper sheet M. Thereafter, the displacement device (not shown) moves the pair of first rollers 268*a* in a direction in which the paper sheet M enters the inversion path (direction denoted by broken arrow) so that a tensile force is generated between the first holding unit 269*a* and the second holding unit 269*b* and the tensile force is applied to the paper sheet M.

After the tensile force is applied to the paper sheet M, the displacement device (not shown) moves the pair of first rollers 268*a* in a direction opposite to the direction in which the paper sheet M enters the inversion path with the pair of second rollers 268*b* being rotated backwards. Thereafter, the pair of first rollers 268*a* is rotated backwards when the pair of first rollers 268*a* reaches an initial position of the pair of first rollers 268*a* so that the paper sheet M, to which the tensile force has been applied, is transported to the post processing unit 300 after being inverted while being switched back in the second inversion path 249.

Note that, in the first embodiment, in order to apply a tensile force to the paper sheet M, the position of the pair of second rollers 268*b* holding the paper sheet M is fixed and the pair of first rollers 268*a* holding the paper sheet M is moved in the direction in which the paper sheet M enters the inversion path. However, the invention is not limited to this and a method of moving the pair of first rollers 268*a* holding the paper sheet M in a direction opposite to the direction in which the paper sheet M enters the inversion path or a method of moving the pair of first rollers 268*a* and the pair of second rollers 268*b* in directions opposite to directions in which the pair of first rollers 268*a* and the pair of second rollers 268*b* face each other may be adopted.

In addition, a tensile force may be applied to the paper sheet M by using a method of fixing the positions of the pair of first rollers 268*a* and the pair of second rollers 268*b* and rotating only the pair of first rollers 268*a* forwards or rotating only the pair of second rollers 268*b* backwards in a state where the pair of second rollers 268*b* holds the trailing end side of the paper sheet M after the pair of first rollers 268*a* holding the leading end side of the paper sheet M is moved in the direction in which the paper sheet M enters the inversion path by a predetermined distance, that is, in a state where the pair of first rollers 268*a* and the pair of second rollers 268*b* hold opposite ends (leading end side and trailing end side) of the paper sheet M while being separated from each other with a predetermined gap therebetween.

Figure 16:
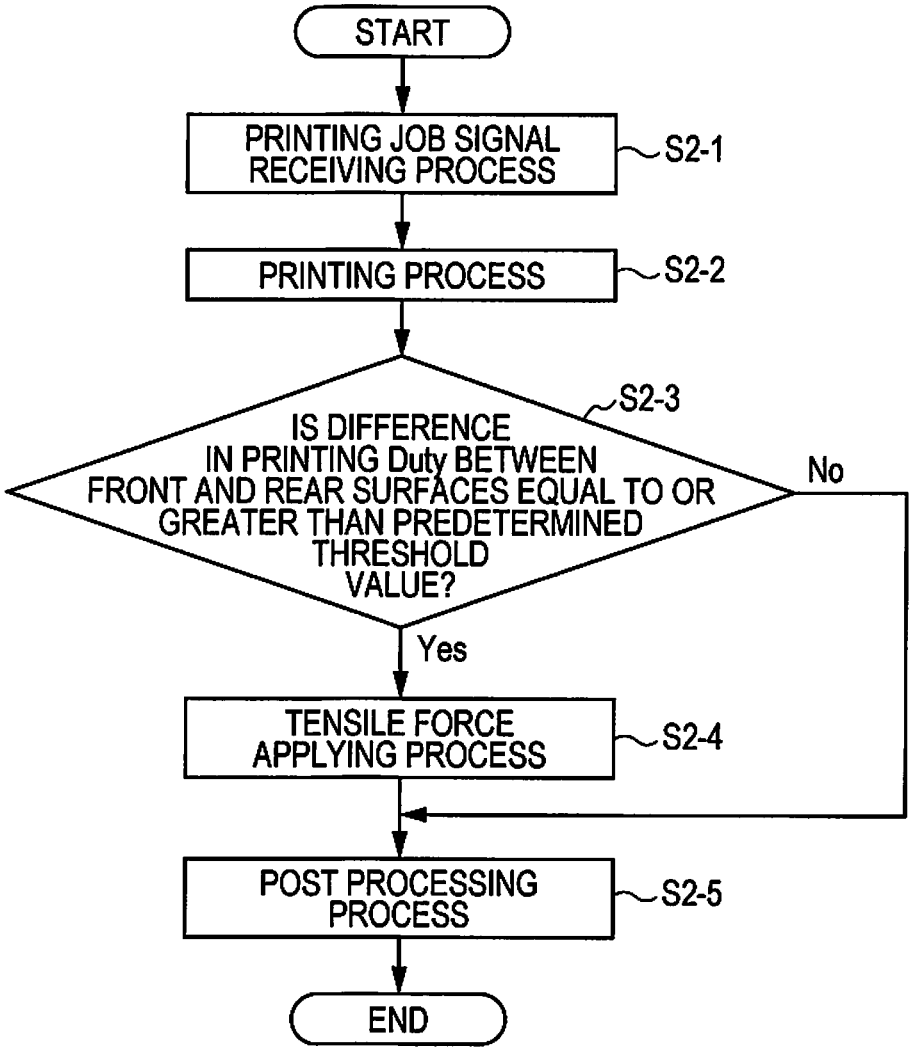
FIG. 16 is a flowchart illustrating an operating method of a printing apparatus which includes the intermediate unit according to the second embodiment.

Operating Method of Printing Apparatus Including Tensile Force Applying Mechanism in Intermediate Unit Next, the operating method of the printing apparatus 1 including the tensile force applying mechanism in the intermediate unit 200*a* will be described. FIG. 16 is a flowchart illustrating an operating method of the printing apparatus which includes the tensile force applying mechanism in the intermediate unit. Note that, in the following description, one surface of the paper sheet M will be referred to as a front surface and the other surface of the paper sheet M which faces the one surface of the paper sheet M will be referred to as a rear surface.

First, a printing job signal from the controller 10 is received (Step S2-1). Next, an image is printed on the paper sheet M in the printing unit 100 on the basis of the printing job signal (Step S2-2). The paper sheet M on which the image has been printed is transported to the intermediate unit 200*a* which includes the transportation path 218.

Thereafter, in the inlet path 243 of the intermediate unit 200*a*, one of the first inversion path 248 which is not provided with the tensile force applying mechanism and the second inversion path 249 which is provided with the tensile force applying mechanism is selected according to a difference in printing duty between the front and rear surfaces of the paper sheet M as the printing data from the controller 10. That is, when the difference in printing duty between the front and rear surfaces of the paper sheet M is equal to or greater than a predetermined threshold value (for example, 30%), the paper sheet M is fed to the second inversion path 249 which is provided with the tensile force applying mechanism and a tensile force is applied to the paper sheet M on which an image has been printed. In addition, in a case where the difference in printing duty between the front and rear surfaces of the paper sheet M is smaller than the predetermined threshold value (for example, 30%), it is not necessary to apply a tensile force to the paper sheet M.

Therefore, the paper sheet M is fed to the first inversion path 248 or the second inversion path 249 so that the paper sheet M is inverted.

In Step S2-3, it is determined whether the difference in printing duty between the front and rear surfaces of the paper sheet M is equal to or greater than the predetermined threshold value. In a case where the result of determination in Step S2-3 is "Yes", the process proceeds to Step S2-4 and in a case where the result of determination in Step S2-3 is "No", since it is not necessary to apply a tensile force to the paper sheet M, the paper sheet M is transported to the post processing unit 300 after being inverted via the first inversion path 248 or the second inversion path 249, and the process proceeds to Step S2-5. Note that, in a case where it is not necessary to apply a tensile force to the paper sheet M and the paper sheet M is inverted by using the second inversion path 249 which is provided with the tensile force applying mechanism, the paper sheet M may be inverted while being switched back at a position on the upstream side of the tensile force applying mechanism. As a result, it is possible to reduce the transportation distance and the transportation time and thus it is possible to perform the inverting process at a high speed.

In Step S2-4, the paper sheet M is fed to the second inversion path 249 which is provided with the tensile force applying mechanism, the tensile force applying mechanism applies a tensile force to the paper sheet M, the paper sheet M is transported to the post processing unit 300 after being inverted while being switched back in the second inversion path 249, and the process proceeds to Step S2-5. At this time, the intensity of the tensile force to be applied to the paper sheet M is changed according to the difference in printing duty between the front and rear surfaces of the paper sheet M. For example, in a case where the difference in printing duty is large, that is, in a case where the amount of moisture contained by the paper sheet M is large, since the tensile strength of the paper sheet M is small, the tensile force to be applied to the paper sheet M is set to be small in order to prevent the paper sheet M from being damaged. In addition, a time for which a tensile force is applied to the paper sheet M may be changed according to the difference in printing duty between the front and rear surfaces of the paper sheet M. For example, in a case where the difference in printing duty is small, a time for which a tensile force is applied to the paper sheet M is set to be short.

In addition, the holding positions at which the paper sheet M is held (position which is separated from leading end of paper sheet M by distance L1 and position which is separated from trailing end of paper sheet M by distance L2) may become close to each other or become distant from each other according to the difference in printing duty between the front and rear surfaces of the paper sheet M. That is, in a case where a region of the paper sheet M to which a tensile force is applied is close to the leading end of the paper sheet M, the holding position of the second holding unit 269*b* is set to a position on the central portion of the paper sheet M (distance L2 becomes long). In addition, in a case where a region of the paper sheet M to which a tensile force is applied is the central portion of the paper sheet M, the holding positions of the first holding unit 269*a* and the second holding unit 269*b* are set to positions close to the central portion (both of distance L1 and distance L2 become long). Accordingly, it is possible to efficiently apply a tensile force to a region of the paper sheet M to which a tensile force is applied.

Note that, air may be sent from the drying unit 270, which includes the air blower, to the paper sheet M in a state where the tensile force applying mechanism applies a tensile force to the paper sheet M. Since the paper sheet M is dried by the air, it is possible to suppress deformation of the paper sheet M such as the second curling effect, which occurs due to the paper sheet M being insufficiently dried in the transportation path 218 including the second inversion path 249 thereafter, and to suppress an increase in friction resistance of the paper sheet M In Step S2-5, the transported paper sheet M is transported to the stacker 328 via the guiding unit 330 and is mounted on the stacker 328 with one end sides of the paper sheets M being aligned. Thereafter, the processing unit 325 performs post processing such as the punching process of punching a punched hole through the paper sheet M, the stapling process of binding a predetermined number of paper sheets M, and the shifting process of shifting the position of the paper sheet M in the width direction thereof per one paper sheet M or per one bundle of paper sheets M for adjustment with respect to the paper sheet M mounted on the stacker 328.

As described above, according to the printing apparatus 1 which includes the tensile force applying mechanism in the intermediate unit 200*a* in the second embodiment, it is possible to achieve the following effect.

Since the transportation path 218 of the intermediate unit 200*a* is provided with the tensile force applying mechanism that applies a tensile force to the paper sheet M, it is possible to maintain a flat shape of the paper sheet M and perform correction such that the shape of the paper sheet M becomes flat in the middle of transportation by using the tensile force applying mechanism and thus it is possible to provide the intermediate unit 200*a* that can suppress the curling of the paper sheet M. Therefore, it is possible to suppress stacking failure which occurs due to deformation such as the curling of the paper sheet M, on which printing has been performed, when the post processing is performed on the paper sheet M discharged from the intermediate unit 200*a*.

In addition, since the transportation path 218 is provided with the inversion paths 248 and 249, the paper sheet M can be inverted upside down in the middle of transportation.

In addition, when the displacement device, which changes the relative position of the first holding unit 269*a* holding one side of the paper sheet M with respect to the second holding unit 269*b* holding the other side of the paper sheet M, moves the first holding unit 269*a*, a tensile force is generated between the first holding unit 269*a* and the second holding unit 269*b* and thus it is possible to apply a tensile force to the paper sheet M. Therefore, it is possible to maintain a flat shape of the paper sheet M and perform correction such that the shape of the paper sheet M becomes flat and thus it is possible to suppress the curling of the paper sheet M.

In addition, since each of the first holding unit 269*a* and the second holding unit 269*b* is constituted by one pair of rollers that nips the paper sheet M, it is possible to hold the paper sheet M by stopping rotation of the rollers after the paper sheet M is nipped.

In addition, when the position of the pair of first rollers 268*a* with respect to the paper sheet M reaches the holding position at which the paper sheet M is held, rotation of the pair of first rollers 268*a* is stopped so that the first holding unit 269*a* holds the paper sheet M and the relative position of the pair of first rollers 268*a* with respect to the pair of second rollers 268*b* is changed and when the paper sheet M reaches the holding position at which the pair of second rollers 268*b* holds the paper sheet M, rotation of the pair of second rollers 268*b* is stopped so that the second holding unit 269*b* holds the paper sheet M. Therefore, a tensile force is generated between the first holding unit 269*a* and the second holding unit 269*b* and thus it is possible to apply a tensile force to the paper sheet M.

In addition, since the holding positions of the pair of first rollers 268*a* and the pair of second rollers 268*b* at which the paper sheet M is held are changed according to the difference in printing duty between the front and rear surfaces of the paper sheet M, it is possible to efficiently apply a tensile force to a region of the paper sheet M to which a tensile force is applied.

In addition, since the intensity of the tensile force to be applied to the paper sheet M is changed according to the difference in printing duty between the front and rear surfaces of the paper sheet M, it is possible to maintain a flat shape of the paper sheet M and perform correction such that the shape of the paper sheet M becomes flat while preventing the paper sheet M from being damaged.

In addition, since a time for which a tensile force is applied to the paper sheet M is changed according to the difference in printing duty between the front and rear surfaces of the paper sheet M, it is possible to maintain a flat shape of the paper sheet M and perform correction such that the shape of the paper sheet M becomes flat in a short time.

In addition, since the tensile force applying mechanism is provided in the second inversion path 249 in which a long region in which the paper sheet M can have a straight shape can be secured, it is possible to reduce the size of the intermediate unit 200*a*.

In addition, since the tensile force applying mechanism is provided in the second inversion path 249 which is a portion of the plurality of inversion paths (248 and 249), it is possible to reduce the size of the intermediate unit 200*a* and to achieve power saving.

In addition, it is possible to dry the paper sheet M by sending air to the paper sheet M to which a tensile force is applied. Therefore, it is possible to suppress deformation of the paper sheet M such as the second curling effect, which occurs due to the paper sheet M being insufficiently dried in the transportation path 218 including the second inversion path 249 thereafter, and to suppress an increase in friction resistance of the paper sheet M.

In addition, since it is possible to maintain a flat shape of the paper sheet M on which printing has been performed and perform correction such that the shape of the paper sheet M becomes flat by using the tensile force applying mechanism provided in the transportation path 218, it is possible to suppress the curling of the paper sheet M. Therefore, it is possible to provide the post processing device 2 with which it is possible to suppress stacking failure which occurs due to the curling of the paper sheet M, on which printing has been performed, when the post processing is performed on the paper sheet M.

In addition, since it is possible to maintain a flat shape of the paper sheet M on which printing has been performed and perform correction such that the shape of the paper sheet M becomes flat by using the tensile force applying mechanism provided in the transportation path 218, it is possible to suppress the curling of the paper sheet M. Therefore, it is possible to provide the printing apparatus 1 with which it is possible to suppress stacking failure which occurs due to the curling of the paper sheet M, on which printing has been performed, when the post processing is performed on the paper sheet M.

Modification Example 1

Figure 17:
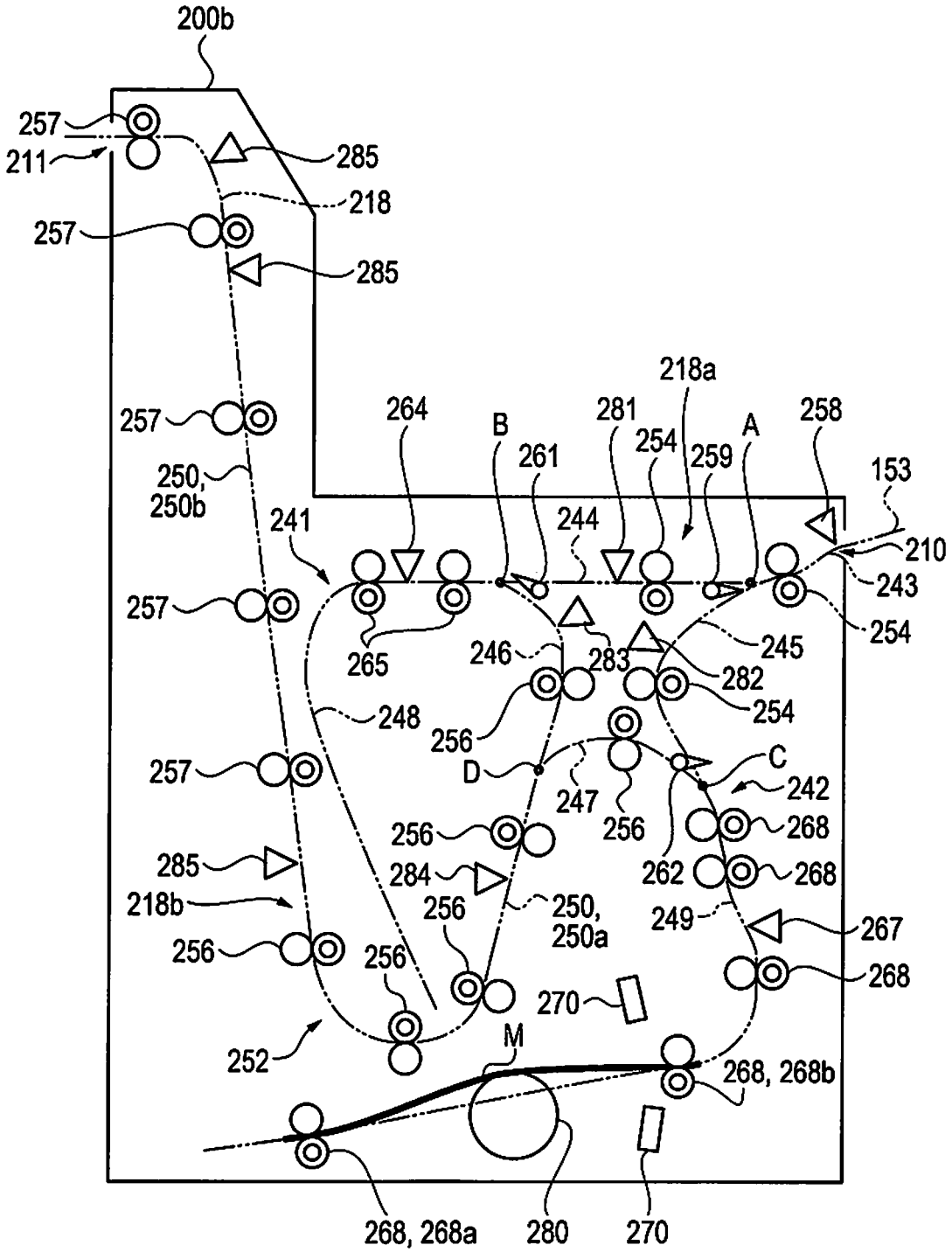
FIG. 17 is a schematic view for explaining the operation of a tensile force applying mechanism of an intermediate unit according to a modification example of the second embodiment.

Next, a tensile force applying mechanism of an intermediate unit 200*b* according to Modification Example 1 of the second embodiment of the invention will be described. FIG. 17 is a schematic view for explaining the operation of the tensile force applying mechanism of the intermediate unit 200*b* according to Modification Example 1 of the second embodiment. Note that, the same components as in the second embodiment are given the same reference numerals and description thereof will not be repeated.

The intermediate unit 200*b* according to Modification Example 1 is different from the intermediate unit 200*a* according to the second embodiment in that the tensile force applying mechanism is provided with a pressing roller 280.

In the intermediate unit 200*b*, the tensile force applying mechanism is provided with the pressing roller 280. The pressing roller 280 is disposed on the downstream side of the pair of second rollers 268*b* in a direction in which the paper sheet M enters the second inversion path 249 and is disposed at a position facing the paper sheet M.

In Modification Example 1, a tensile force is applied to the paper sheet M on which printing has been performed via a method of causing the pressing roller 280 come into contact with the central portion of the paper sheet M in a state where the pair of first rollers 268*a* and the pair of second rollers 268*b* hold the paper sheet M with a predetermined gap provided therebetween and the positions of the pair of first rollers 268*a* and the pair of second rollers 268*b* are fixed and moving the pressing roller 280 in a direction intersecting a direction in which the paper sheet M enters the second inversion path 249.

Note that, in the Modification Example 1, a tensile force is applied to the paper sheet M by moving the pressing roller 280. However, the invention is not limited to this and the pressing roller 280 may be an elliptic roller or an eccentric roller. If the pressing roller 280 is an elliptic roller or an eccentric roller, it is possible to apply a tensile force to the paper sheet M only by rotating the pressing roller 280 and thus it is possible to simplify the configuration.

According to this configuration, it is possible to generate a tensile force between the pair of first rollers 268*a* and the pair of second rollers 268*b* holding the paper sheet M and thus it is possible to apply the tensile force to the paper sheet M. Therefore, it is possible to maintain a flat shape of the paper sheet M and perform correction such that the shape of the paper sheet M becomes flat and thus it is possible to provide the intermediate unit 200*b* that can suppress the curling of the paper sheet M.

Third Embodiment

Figure 18:
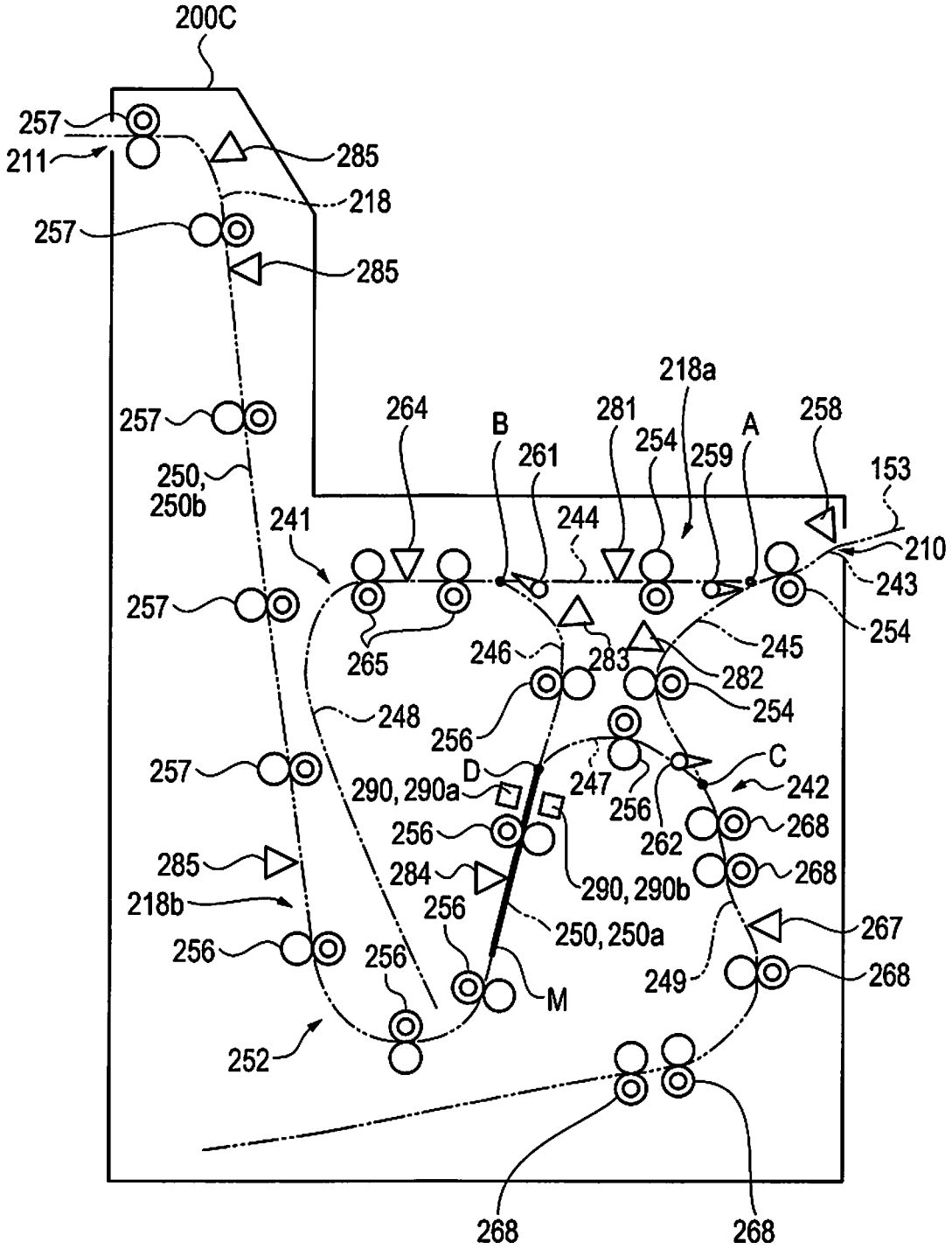
FIG. 18 is a schematic view for explaining the operation of a liquid ejecting unit of an intermediate unit according to a third embodiment.

Next, a liquid ejecting unit 290 of an intermediate unit 200*c* according to a third embodiment of the invention will be described. FIG. 18 is a schematic view for explaining the operation of the liquid ejecting unit of the intermediate unit according to the third embodiment. Note that, the same components as in the first embodiment are given the same reference numerals and description thereof will not be repeated. Note that, in the following description, one surface of the paper sheet M will be referred to as a front surface and the other surface of the paper sheet M which faces the one surface of the paper sheet M will be referred to as a rear surface.

The intermediate unit 200*c* according to the third embodiment is different from the intermediate unit 200 according to the first embodiment in that the intermediate unit 200*c* does not include the drying unit 270 and includes the liquid ejecting unit 290 that ejects liquid onto the paper sheet M.

Liquid Ejecting Unit

The intermediate unit 200*c* is provided with the liquid ejecting units 290 (in third embodiment, two liquid ejecting units of first liquid ejecting unit 290*a* and second liquid ejecting unit 290*b*) that are capable of ejecting liquid including water to front and rear surfaces of the paper sheet M so as to suppress deformation such as the second curling effect of the paper sheet M. Each of the liquid ejecting units 290 includes a liquid ejecting head that ejects liquid and is provided in the outlet path 250, which is a portion of the transportation path 218, as illustrated in FIG. 18. Regarding the liquid ejecting units 290, the first liquid ejecting unit 290*a* as a first liquid ejecting head is disposed at a position facing the front surface, which is one surface of the paper sheet M, and the second liquid ejecting unit 290*b* as a second liquid ejecting head is disposed at a position facing the rear surface, which is the other surface of the paper sheet M. Therefore, it is possible to eject liquid to the front and rear surfaces of the paper sheet M.

Note that, the liquid ejecting head is a line head and can linearly eject liquid in a direction intersecting the transportation direction of the paper sheet M instantly. Therefore, it is possible to reduce a time for ejection.

Regarding the paper sheet M which is supplied to the outlet path 250 provided with the liquid ejecting unit 290, when the paper sheet M is transported along the outlet path 250, the liquid ejecting unit 290 ejects liquid to one of the front and rear surfaces of the paper sheet M with a smaller amount of moisture according to a difference in amount of moisture between the front and rear surfaces of the paper sheet M, that is, when it is determined that the difference in amount of moisture between the front and rear surfaces of the paper sheet M has reached a determination value. Here, since liquid is ejected such that the difference in amount of moisture between the front and rear surfaces of the paper sheet M falls within a predetermined range, it is possible to suppress deformation such as the second curling effect which occurs due to a difference in drying time caused by the difference in amount of moisture between the front and rear surfaces of the paper sheet M in the transportation path 218.

Note that, in the case of the paper sheet M which is subject to simplex printing, since the amount of moisture on the recording surface is large, it is preferable to eject liquid to a surface on which printing is not performed (rear surface). That is, liquid is ejected onto the rear surface of the recording surface such that the difference in amount of moisture between the recording surface and the rear surface of the paper sheet M falls within a predetermined range.

In addition, the amount of liquid to be ejected may be controlled according to the humidity in the usage environment of the printing unit 100, the intermediate unit 200, and the like and the amount of moisture on the recording surface. For example, in a case where the humidity is lower than a predetermined threshold value and the amount of liquid to be ejected onto the rear surface of the recording surface is equal to or greater than a predetermined threshold value, the amount of liquid to be ejected is set to the largest amount (condition A). On the other hand, in a case where the humidity is lower than the predetermined threshold value or the amount of liquid to be ejected onto the rear surface of the recording surface is equal to or greater than the predetermined threshold value, the amount of liquid to be ejected is set to be the second largest amount which is smaller than in the case of the condition A. Furthermore, in a case where the humidity is equal to or greater than the predetermined threshold value and the amount of liquid to be ejected onto the rear surface of the recording surface is smaller than the predetermined threshold value, liquid is not ejected.

In addition, in a case where liquid is ejected onto the rear surface of the recording surface of the paper sheet M which is subject to simplex printing, liquid may be ejected onto a region of the rear surface which corresponds to a side opposite to a region on which the printing is performed and liquid may be ejected onto the entire portion of the rear surface. Furthermore, liquid may be ejected onto the rear surface in a lattice pattern and liquid may be ejected onto a region including a corner portion of the paper sheet M which is most likely to be influenced by the degree of curling or an end portion of the paper sheet M.

In addition, in a case where the paper sheet M is divided into a plurality of regions, a determination value with respect to a region including a corner portion of the paper sheet M from among the plurality of regions may be smaller than a determination value with respect to the other region of the paper sheet M. This is because the amount of curling deformation (curving amount) of the region including the corner portion of the paper sheet M which accompanies the drying of moisture is larger than that of the other region of the paper sheet M and if the determination value with respect to the region including the corner portion is smaller than the determination value with respect to the other region, it is possible to decrease the amount of curling deformation of the region including the corner portion of the paper sheet M.

Thereafter, the paper sheet M onto which liquid has been ejected is dried while being transported along the transportation path 218 and is transported to the post processing unit 300.

Figure 19:
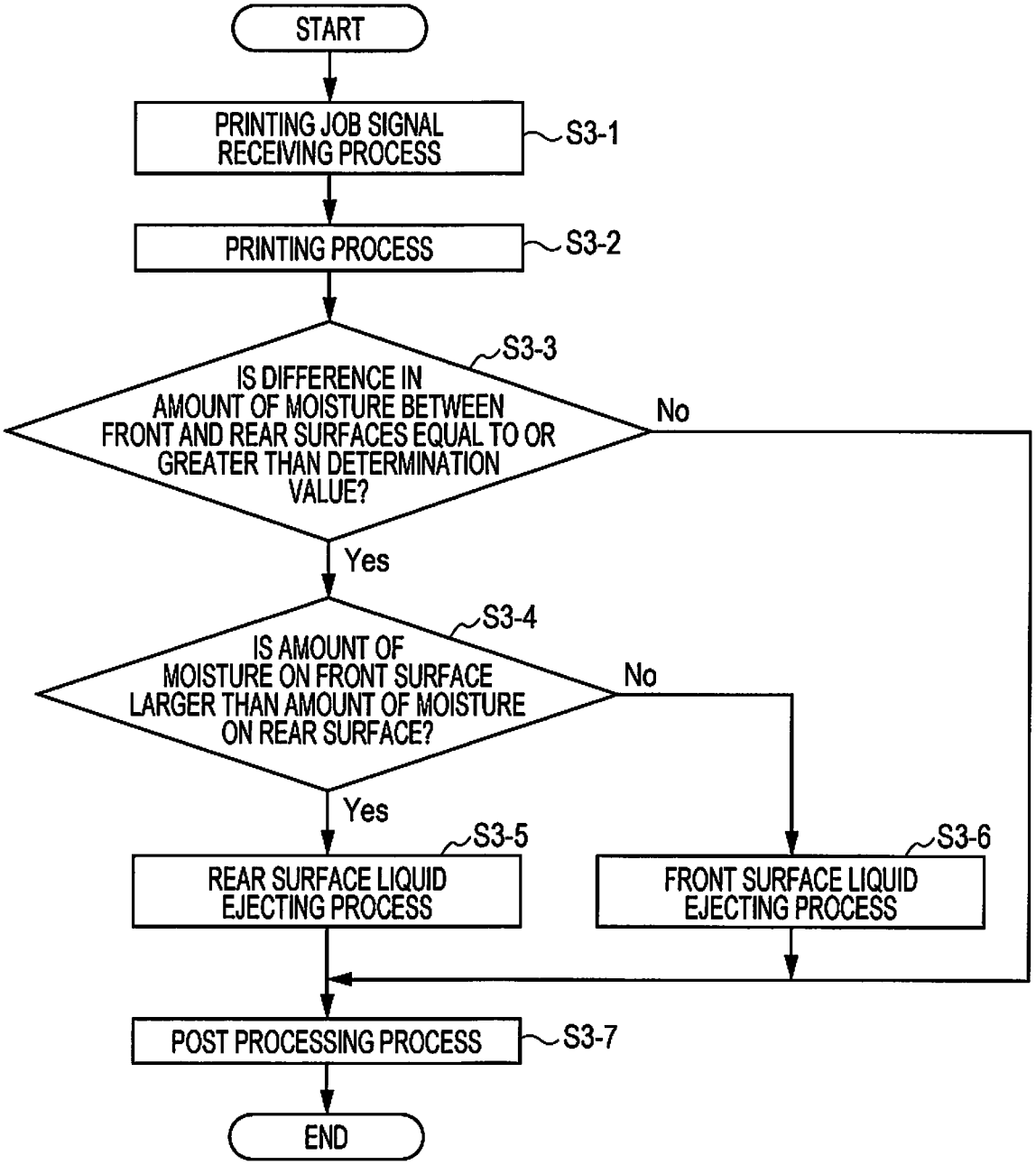
FIG. 19 is a flowchart illustrating an operating method of a printing apparatus which includes the intermediate unit according to the third embodiment.

Operating Method of Printing Apparatus Including Liquid Ejecting Unit in Intermediate Unit Next, the operating method of the printing apparatus 1 including the liquid ejecting unit 290 in the intermediate unit 200*c* will be described. FIG. 19 is a flowchart illustrating an operating method of the printing apparatus which includes the liquid ejecting unit in the intermediate unit.

First, a printing job signal from the controller 10 is received (Step S3-1). Next, an image is printed on the paper sheet M in the printing unit 100 on the basis of the printing job signal (Step S3-2). The paper sheet M on which the image has been printed is transported to the intermediate unit 200*c* which includes the transportation path 218.

Thereafter, in the outlet path 250, the liquid ejecting unit 290 (first liquid ejecting unit 290*a* or second liquid ejecting unit 290*b*) ejects liquid onto the paper sheet M which is inverted in the inversion path such that a difference in amount of moisture between front and rear surfaces of the paper sheet M falls within a predetermined range (for example, 30%) according to the amount of moisture that is calculated from the printing duty as the printing data from the controller 10.

In Step S3-3, it is determined whether the difference in amount of moisture between the front and rear surfaces is equal to or greater than the determination value (for example, 30%). In a case where the result of determination in Step S3-3 is "Yes", the process proceeds to Step S3-4 and in a case where the result of determination in Step S3-3 is "No", since it is not necessary to eject liquid to the paper sheet M, the paper sheet M is transported to the post processing unit 300 while being transported along the transportation path 218 and the process proceeds to Step S3-7.

In Step S3-4, the amount of moisture on the front surface of the paper sheet M is compared with the amount of moisture on the rear surface of the paper sheet M and in a case where the amount of moisture on the front surface of the paper sheet M is larger than the amount of moisture on the rear surface of the paper sheet M, the result of determination in Step S3-4 becomes "Yes" and the process proceeds to Step S3-5. In a case where the amount of moisture on the front surface of the paper sheet M is smaller than the amount of moisture on the rear surface of the paper sheet M, the result of determination in Step S3-4 becomes "No" and the process proceeds to Step S3-6.

In Step S3-5, since it is necessary to eject liquid onto the rear surface of the paper sheet M, the second liquid ejecting unit 290*b* ejects liquid onto the rear surface of the paper sheet M such that the difference in amount of moisture between the front and rear surfaces of the paper sheet M falls within the predetermined range. Thereafter, the paper sheet M is transported to the post processing unit 300 and the process proceeds to Step S3-7.

In Step S3-6, since it is necessary to eject liquid onto the front surface of the paper sheet M, the first liquid ejecting unit 290*a* ejects liquid onto the front surface of the paper sheet M such that the difference in amount of moisture between the front and rear surfaces of the paper sheet M falls within the predetermined range. Thereafter, the paper sheet M is transported to the post processing unit 300 and the process proceeds to Step S3-7.

In Step S3-7, the transported paper sheet M is transported to the stacker 328 via the guiding unit 330 and is mounted on the stacker 328 with one end sides of the paper sheets M being aligned. Thereafter, the processing unit 325 performs post processing such as the punching process of punching a punched hole through the paper sheet M, the stapling process of binding a predetermined number of paper sheets M, and the shifting process of shifting the position of the paper sheet M in the width direction thereof per one paper sheet M or per one bundle of paper sheets M for adjustment with respect to the paper sheet M mounted on the stacker 328.

As described above, according to the printing apparatus 1 which includes the liquid ejecting unit 290 in the intermediate unit 200*c* in the third embodiment, it is possible to achieve the following effect.

Since the liquid ejecting unit 290 provided in the intermediate unit 200*c* can eject liquid onto one of the front and rear surfaces of the paper sheet M with a smaller amount of moisture according to a difference in amount of moisture between the front and rear surfaces of the paper sheet M, it is possible to provide the intermediate unit 200*c* that can suppress the curling of the paper sheet M that occurs due to a difference in drying time between the front and rear surfaces of the paper sheet M, which is caused by the difference in amount of moisture between the front and rear surfaces of the paper sheet M, even in the case of duplex printing. Therefore, it is possible to suppress stacking failure which occurs due to the curling of the paper sheet M, on which printing has been performed, when the post processing is performed on the paper sheet M which is discharged from the intermediate unit 200*c*.

In addition, since the liquid ejecting unit 290 can eject liquid onto the paper sheet M such that the difference in amount of moisture between the front and rear surfaces of the paper sheet M falls within the predetermined range, it is possible to equalize the drying times for the front and rear surfaces of the paper sheet M and thus it is possible to suppress the curling of the paper sheet M.

In addition, if a determination value with respect to a region including a corner portion of the paper sheet M is smaller than a determination value with respect to the other region of the paper sheet M, it is possible to decrease the amount of curling of the region including the corner portion of the paper sheet M.

In addition, since the liquid ejecting unit 290 is provided in the transportation path 218, it is possible to reduce the size of the intermediate unit 200*c*.

In addition, since the liquid ejecting unit 290 is provided with the liquid ejecting head, it is possible to eject liquid such that the difference in amount of moisture between the front and rear surfaces of the paper sheet M falls within the predetermined range in a short time and at high accuracy.

In addition, since the liquid ejecting unit 290 includes the first liquid ejecting unit 290*a* that faces one surface of the paper sheet M and the second liquid ejecting unit 290*b* that faces the other surface of the paper sheet M, it is possible to eject liquid onto the front and rear surfaces of the paper sheet M (therefore, it is possible to cope with a case where the paper sheet M has a region in which a difference in amount of moisture between the front and rear surfaces of the paper sheet M is different between the front and rear surfaces).

In addition, since the liquid ejecting head is a line head, it is possible to linearly eject liquid in a direction intersecting the transportation direction of the paper sheet M instantly and thus it is possible to reduce a time for ejection.

In addition, since the liquid ejecting unit 290 provided in the transportation path 218 can eject liquid onto the paper sheet M, on which printing has been performed, such that the difference in amount of moisture between the front and rear surfaces of the paper sheet M falls within the predetermined range, it is possible to suppress the curling of the paper sheet M that occurs due to a difference in drying time which is caused by the difference in amount of moisture between the front and rear surfaces of the paper sheet M. Therefore, it is possible to provide the post processing device 2 with which it is possible to suppress stacking failure which occurs due to the curling of the paper sheet M, on which printing has been performed, when the post processing is performed on the paper sheet M.

In addition, since the liquid ejecting unit 290 provided in the transportation path 218 can eject liquid onto the paper sheet M, on which printing has been performed, such that the difference in amount of moisture between the front and rear surfaces of the paper sheet M falls within the predetermined range, it is possible to suppress the curling of the paper sheet M that occurs due to a difference in drying time which is caused by the difference in amount of moisture between the front and rear surfaces of the paper sheet M. Therefore, it is possible to provide the printing apparatus 1 with which it is possible to suppress stacking failure which occurs due to the curling of the paper sheet M, on which printing has been performed, when the post processing is performed on the paper sheet M.

Modification Example 2

Next, the liquid ejecting unit 290 according to Modification Example 2 of the third embodiment of the invention will be described.

The position of the liquid ejecting unit 290 according to Modification Example 2 is different from the position of the liquid ejecting unit 290 according to the third embodiment and the liquid ejecting unit 290 according to Modification Example 2 is disposed on the upstream side of the outlet path 250 which is a portion of the transportation path 218.

According to this configuration, it is possible to lengthen a portion of the transportation path 218 which is on the downstream side of the liquid ejecting unit 290 and it is possible to lengthen a time for drying liquid, which is ejected to suppress deformation such as the second curling effect of the paper sheet M. Therefore, it is possible to suppress an increase in friction resistance of the paper sheet M which occurs due to the paper sheet M being insufficiently dried.

Note that, it is preferable that the liquid ejecting unit 290 be provided in the inlet path 243 which is on the upstream side of the branch paths 244 and 245. If the liquid ejecting unit 290 is provided in the inlet path 243, it is possible to lengthen a portion of the transportation path 218 which is on the downstream side of the liquid ejecting unit 290 and it is possible to lengthen a time for drying the ejected liquid. Therefore, it is possible to suppress an increase in friction resistance of the paper sheet M which occurs due to the paper sheet M being insufficiently dried. In addition, since only one liquid ejecting unit 290 is provided, it is possible to achieve a reduction in cost and size of the printing apparatus 1 or the post processing device 2.

Hereinabove, the intermediate units 200, 200*a*, 200*b*, and 200*c*, the post processing device 2, and the printing apparatus 1 of the invention have been described on the basis of the embodiments illustrated in the drawings. However, the invention is not limited to this and the configuration of each component may be replaced with an arbitrary configuration having the same function. In addition, another arbitrary component may be added to the invention. In addition, the above-described embodiments may be appropriately combined to each other. That is, the drying unit 270, the tensile force applying mechanism, and the liquid ejecting unit 290 may be combined to each other to suppress a decrease in friction resistance of a medium or the curling of the medium which depends on moisture of liquid.

The invention can be realized in the following aspects or application examples.

Application Example 1

According to this application example, there is provided an intermediate unit including a transportation path along which a medium, on which printing has been performed by a printing unit that performs printing on the medium by using liquid, is transported to a post processing unit that performs post processing on the medium, in which the transportation path is provided with a drying unit that accelerates the drying of the medium.

According to the application example, since the transportation path is provided with the drying unit that accelerates the drying of the medium, it is possible to sufficiently dry the medium by using the drying unit in the middle of transportation and thus it is possible to provide an intermediate unit that can suppress the curling of a medium. Therefore, it is possible to suppress stacking failure which occurs due to the curling of the medium when the post processing is performed on the medium discharged from the intermediate unit and it is possible to suppress alignment failure which occurs due to a high friction resistance of the medium on which printing has been performed.

Application Example 2

In the intermediate unit according to the application example, the transportation path is preferably provided with an inversion path in which the medium is inverted upside down.

According to the application example, since the transportation path is provided with the inversion path, the medium can be inverted upside down in the middle of transportation.

Application Example 3

In the intermediate unit according to the application example, the drying unit is preferably provided in the inversion path.

According to the application example, since the drying unit is provided in the inversion path, it is possible to secure a long region in which the medium can have a straight shape when the medium is dried. Therefore, it is possible to reduce the size of the intermediate unit.

Application Example 4

In the intermediate unit according to the application example, a plurality of the inversion paths are preferably provided, and the drying unit is preferably provided in a specific inversion path of the plurality of the inversion paths.

According to the application example, since the drying unit is provided in the specific inversion path of the plurality of the inversion paths, it is possible to reduce the size of the intermediate unit and to achieve power saving.

Application Example 5

In the intermediate unit according to the application example, one of the plurality of inversion paths is preferably selected according to printing data for the medium.

According to the application example, since one of the plurality of inversion paths is selected according to printing data for the medium, the medium can be inverted efficiently.

Application Example 6

In the intermediate unit according to the application example, it is preferably determined whether a difference in amount of moisture between front and rear surfaces of the medium, which is based on the printing data, is equal to or greater than a predetermined threshold value and the drying unit is preferably driven if the difference is equal to or greater than a predetermined threshold value.

According to the application example, since it is possible to dry the medium by driving the drying unit if a difference in amount of moisture between the front and rear surfaces of the medium, which is based on the printing data, is equal to or greater than the predetermined threshold value, it is possible to suppress the curling of the medium and it is possible to decrease the friction resistance of the medium which depends on moisture of liquid.

Application Example 7

In the intermediate unit according to the application example, a medium, in which a difference in amount of moisture between front and rear surfaces which is based on the printing data is equal to or greater than the predetermined threshold value, is preferably transported along the specific inversion path, and a medium, in which a difference in amount of moisture between front and rear surfaces which is based on the printing data is smaller than the predetermined threshold value, is preferably transported along one of the plurality of inversion paths other than the specific inversion path.

According to the application example, since it is possible to dry the medium by transporting the medium, in which a difference in amount of moisture between the front and rear surfaces of the medium which is based on the printing data is equal to or greater than the predetermined threshold value, to the specific inversion path which is provided with the drying unit, it is possible to suppress the curling of the medium and it is possible to decrease the friction resistance of the medium which depends on moisture of liquid.

Application Example 8

In the intermediate unit according to the application example, the drying unit preferably includes a first drying unit that faces one surface of the medium and a second drying unit that faces the other surface of the medium.

According to the application example, since the first drying unit that faces one surface of the medium and the second drying unit that faces the other surface of the medium are provided, it is possible to dry both surfaces of the medium at the same time and thus it is possible to further accelerate the drying of the medium.

Application Example 9

In the intermediate unit according to the application example, the first drying unit and the second drying unit are preferably controlled independently of each other according to the printing data.

According to the application example, since the first drying unit and the second drying unit are controlled independently of each other according to the printing data, it is possible to achieve a good balance between the degree of drying of one surface of the medium and the degree of drying of the other surface and to suppress deformation of the medium which occurs due to a second curling effect or the like.

Application Example 10

In the intermediate unit according to the application example, the drying unit is preferably an air blower.

According to the application example, since the medium is dried with the air blower sending air to the medium, it is possible to easily suppress deformation such as the curling of the medium using the air pressure of the sent air. In addition, since no heat source is used, it is possible to achieve power saving in the intermediate unit.

Application Example 11

In the intermediate unit according to the application example, the inversion path provided with the air blower is preferably configured as a switch-back type inversion path, the inversion path is preferably provided with a holding unit that holds the medium entering the inversion path and that is disposed on the downstream side of the air blower in a direction in which the medium enters the inversion path, and the holding unit preferably holds a portion of the medium which is closer to a trailing end of the medium than to a tip end of the medium in a direction in which the medium enters the inversion path.

According to the application example, since the holding unit which is on the downstream side of the air blower holds a portion of the medium which is close to the trailing end of the medium, it is possible to apply air to the medium and to secure a long region, in which the medium has a straight shape. Therefore, it is possible to dry the medium in a state where the medium has a straight shape and thus it is possible to easily suppress deformation such as the curling of the medium.

Application Example 12

In the intermediate unit according to the application example, in the inversion path, a medium for which a drying process that is performed by the drying unit is omitted is preferably switched back at a position on the upstream side of the drying unit in a direction in which the medium enters the inversion path.

According to the application example, since the medium for which a drying process is omitted is switched back at a position on the upstream side of the drying unit, it is possible to reduce the transportation distance and the transportation time and thus it is possible to perform the inverting process at a high speed.

Application Example 13

In the intermediate unit according to the application example, the transportation path is preferably provided with a tensile force applying mechanism that applies a tensile force along the transportation path to the medium.

According to the application example, since the transportation path of the intermediate unit is provided with the tensile force applying mechanism that applies a tensile force to the medium, it is possible to maintain a flat shape of the medium and perform correction such that the shape of the medium becomes flat in the middle of transportation by using the tensile force applying mechanism and thus it is possible to provide the intermediate unit that can suppress the curling of the medium. Therefore, it is possible to suppress stacking failure which occurs due to deformation such as the curling of the medium, on which printing has been performed, when the post processing is performed on the medium discharged from the intermediate unit.

Application Example 14

According to this application example, there is provided a post processing device which performs post processing on a medium on which printing has been performed by a printing unit that performs printing on the medium by using liquid, the post processing device including a post processing unit that performs the post processing on the medium and a transportation path along which the medium is transported to the post processing unit, in which the transportation path is provided with a drying unit that accelerates the drying of the medium.

According to this application example, since it is possible to sufficiently dry the medium, on which printing has been performed, by using the drying unit provided in the transportation path, it is possible to suppress the curling of the medium and thus it is possible to decrease the friction resistance of the medium which depends on moisture of liquid. Therefore, it is possible to provide the post processing device with which it is possible to suppress stacking failure which occurs due to the curling of the medium, on which printing has been performed, when the post processing is performed on the medium and it is possible to suppress alignment failure which occurs due to a high friction resistance.

Application Example 15

In the post processing device according to the application example, the transportation path is preferably provided with an inversion path in which the medium is inverted upside down.

According to the application example, since the transportation path is provided with the inversion path, the medium can be inverted upside down in the middle of transportation.

Application Example 16

According to this application example, there is provided a printing apparatus including a printing unit that performs printing on a medium by using liquid, a post processing unit that performs post processing on the medium on which printing has been performed by the printing unit, and a transportation path along which the medium is transported from the printing unit to the post processing unit, in which the transportation path includes an inversion path in which the medium is inverted upside down, and the transportation path is provided with a drying unit that accelerates the drying of the medium.

According to the application example, since it is possible to sufficiently dry the medium, on which printing has been performed, by using the drying unit provided in the transportation path, it is possible to suppress the curling of the medium and thus it is possible to decrease the friction resistance of the medium which depends on moisture of liquid. Therefore, it is possible to provide the printing apparatus with which it is possible to suppress stacking failure which occurs due to the curling of the medium, on which printing has been performed, when the post processing is performed on the medium and it is possible to suppress alignment failure which occurs due to a high friction resistance.

What is claimed is:

1. An intermediate unit comprising:

a transportation path along which a medium, on which printing has been performed by a printing unit that performs printing on the medium by using liquid, is transported to a post processing unit that performs post processing on the medium;

wherein the transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

2. The intermediate unit according to claim 1, wherein it is determined whether a difference in amount of moisture between front and rear surfaces of the medium, which is based on the printing data, is equal to or greater than a predetermined threshold value and the decurling unit is driven if the difference is equal to or greater than the predetermined threshold value.

3. The intermediate unit according to claim 2, wherein a medium, in which a difference in amount of moisture between front and rear surfaces, which is based on the printing data, is equal to or greater than the predetermined threshold value, is transported along the second inversion path, and wherein a medium, in which a difference in amount of moisture between front and rear surfaces, which is based on the printing data, is smaller than the predetermined threshold value, is transported along the second inversion path.

4. The intermediate unit according to claim 1, wherein the decurling unit includes a first decurling unit that faces one surface of the medium and a second decurling unit that faces the other surface of the medium.

5. The intermediate unit according to claim 4, wherein the first decurling unit and the second decurling unit are controlled independently of each other according to the printing data.

6. The intermediate unit according to claim 5, wherein the decurling unit is a tensile force applying mechanism that applies a tensile force along the transportation path to the medium.

7. The intermediate unit according to claim 6, wherein the tensile force applying mechanism includes a first roller pair and a second roller pair, and wherein the tensile applying mechanism applies tensile force to the medium which is nipped by the first roller pair and the second roller pair.

8. The intermediate unit according to claim 7, wherein, in the second inversion path, a medium for which a decurling process that is performed by the decurling unit is omitted is switched back at a position on the upstream side of the decurling unit in a direction in which the medium enters the second inversion path.

9. An intermediate unit comprising:

a transportation path along which a medium, on which printing has been performed by a printing unit that performs printing on the medium by using liquid, is transported to a post processing unit that performs post processing on the medium;

wherein the transportation path is provided with a decurling unit that a corrects curl of the medium, wherein the transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the intermediate unit to the branch point, the second path extending from the branch point to an downstream end of the transportation path in the intermediate unit, the switch-back type inversion path extending from the branch point such that the switch-back type inversion path does not connect with the first and second paths except for the branch point, and wherein the decurling unit is provided in the switch-back type inversion path.

10. The intermediate unit according to claim 9, wherein the transportation path is provided with a plurality of inversion paths, and wherein the decurling unit is provided in a specific inversion path of the plurality of the inversion paths.

11. The intermediate unit according to claim 10, wherein one of the plurality of inversion paths is selected according to printing data for the medium.

12. A post processing device which performs post processing on a medium on which printing has been performed by a printing unit that performs printing on the medium by using liquid, the post processing device comprising:

a post processing unit that performs the post processing on the medium; and a transportation path along which the medium is transported to the post processing unit, wherein the transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

13. A post processing device which performs post processing on a medium on which printing has been performed by a printing unit that performs printing on the medium by using liquid, the post processing device comprising:

a post processing unit that performs the post processing on the medium; and a transportation path along which the medium is transported to the post processing unit, wherein the transportation path is provided with a decurling unit that accelerates the decurling of the medium, wherein the transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the post processing unit to the branch point, the second path extending from the branch point to an downstream end of the transportation path in the post processing unit, the switch-back type inversion path extending from the branch point such that the switch-back type inversion path does not connect with the first and second paths except for the branch point, and wherein the decurling unit is provided in the switch-back type inversion path.

14. A printing apparatus comprising:

a printing unit that performs printing on a medium by using liquid;

a post processing unit that performs post processing on the medium on which printing has been performed by the printing unit; and a transportation path along which the medium is transported from the printing unit to the post processing unit, wherein the transportation path includes first and second inversion paths in which the medium is inverted upside down, respectively, the second inversion path being provided with a decurling unit that corrects curl of the medium, the first inversion path being not provided with the decurling unit, the first and second inversion paths being selectively used to invert the medium upside down according to printing data for the medium.

15. A printing apparatus comprising:

a printing unit that performs printing on a medium by using liquid;

a post processing unit that performs post processing on the medium on which printing has been performed by the printing unit; and a transportation path along which the medium is transported from the printing unit to the post processing unit, wherein the transportation path includes a first path with an inlet path, a second path with an outlet path, and a switch-back type inversion path in which the medium is inverted upside down, the first path, the second path and the switch-back type inversion path merging with respect to each other at a branch point, the first path extending from an upstream end of the transportation path in the printing unit to the branch point, the second path extending from the branch point to an downstream end of the transportation path in the printing unit, the switch-back type inversion path extending from the branch point such that the switch-back type inversion path does not connect with the first and second paths except for the branch point, wherein the transportation path is provided with a decurling unit that corrects curl of the medium, and wherein the decurling unit is provided in the switch-back type inversion path.

16. An intermediate unit comprising:

a transportation path along which a medium, on which printing has been performed by a printing unit that performs printing on the medium by using liquid, is transported to a post processing unit that performs post processing on the medium;

wherein the transportation path includes an inversion path in which the medium is inverted upside down, and includes an outlet path in which the medium that has been transported from the inversion path is transported to the post processing unit, the outlet path being disposed downstream of the inversion path and being different from the inversion path, and wherein the outlet path is provided with a decurling unit that corrects curl of the medium.

17. The intermediate unit according to claim 16, wherein the transportation path is provided with a plurality of inversion paths.

18. The intermediate unit according to claim 17, wherein one of the plurality of inversion paths is selected according to printing data for the medium.

19. A post processing device which performs post processing on a medium on which printing has been performed by a printing unit that performs printing on the medium by using liquid, the post processing device comprising:

a post processing unit that performs the post processing on the medium; and a transportation path along which the medium is transported to the post processing unit, wherein the transportation path includes an inversion path in which the medium is inverted upside down, and includes an outlet path in which the medium that has been transported from the inversion path is transported to the post processing unit, the outlet path being disposed downstream of the inversion path and being different from the inversion path, and wherein the outlet path is provided with a decurling unit that corrects curl of the medium.

20. A printing apparatus comprising:

a printing unit that performs printing on a medium by using liquid;

a post processing unit that performs post processing on the medium on which printing has been performed by the printing unit; and a transportation path along which the medium is transported from the printing unit to the post processing unit, wherein the transportation path includes an inversion path in which the medium is inverted upside down, and includes an outlet path in which the medium that has been transported from the inversion path is transported to the post processing unit, the outlet path being disposed downstream of the inversion path and being different from the inversion path, and wherein the outlet path is provided with a decurling unit that corrects curl of the medium.

* * * * *